US010113763B2

(12) United States Patent
Ochiai et al.

(10) Patent No.: US 10,113,763 B2
(45) Date of Patent: Oct. 30, 2018

(54) REFRIGERATION CYCLE APPARATUS

(71) Applicant: Mitsubishi Electric Corporation, Tokyo (JP)

(72) Inventors: Yasutaka Ochiai, Tokyo (JP); Fumitake Unezaki, Tokyo (JP); Makoto Saito, Tokyo (JP); Kazuhiro Komatsu, Tokyo (JP); Junji Hori, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 40 days.

(21) Appl. No.: 14/900,640

(22) PCT Filed: Jul. 10, 2013

(86) PCT No.: PCT/JP2013/068855
§ 371 (c)(1),
(2) Date: Dec. 22, 2015

(87) PCT Pub. No.: WO2015/004747
PCT Pub. Date: Jan. 15, 2015

(65) Prior Publication Data

US 2016/0146488 A1 May 26, 2016

(51) Int. Cl.

| | |
|---|---|
| ***F25B 45/00*** | (2006.01) |
| ***F24F 11/30*** | (2018.01) |
| ***F25B 13/00*** | (2006.01) |
| ***F24F 11/89*** | (2018.01) |
| *F24F 110/00* | (2018.01) |
| *F24F 11/32* | (2018.01) |
| *F24F 11/36* | (2018.01) |

(52) U.S. Cl.
CPC ..... *F24F 11/30* (2018.01); *F24F 11/89* (2018.01); *F25B 13/00* (2013.01); *F24F 11/32* (2018.01);

(Continued)

(58) Field of Classification Search
CPC ... F24F 11/001; F24F 5/001; F25B 2313/006; F25B 25/005
See application file for complete search history.

(56) References Cited

U.S. PATENT DOCUMENTS 5,947,373 A * 9/1999 Saito ..... F24F 1/0003 165/240
6,370,895 B1 * 4/2002 Sakuma ..... F25B 5/02 62/152

(Continued)

FOREIGN PATENT DOCUMENTS

JP 63-286663 A 11/1988
JP 2009-079842 A 4/2009

(Continued)

OTHER PUBLICATIONS

International Search Report of the International Searching Authority dated Oct. 15, 2013 for the corresponding International application No. PCT/JP2013/068855 (and English translation).

(Continued)

*Primary Examiner* — Len Tran
*Assistant Examiner* — Kamran Tavakoldavani
(74) *Attorney, Agent, or Firm* — Posz Law Group, PLC

(57) ABSTRACT

A refrigeration cycle apparatus Including a refrigerant circuit configured to circulate refrigerant to a compressor, an indoor heat exchanger, an expansion valve, and an outdoor heat exchanger, the compressor being connected to the indoor heat exchanger by a gas extension pipe, the expansion valve being connected to the outdoor heat exchanger by a liquid extension pipe; pressure sensors and temperature sensors to detect an operating state amount of the refrigerant circuit; and a controller to execute refrigerant-leakage detection operation of detecting refrigerant leakage by calculating a refrigerant amount in the refrigerant circuit based on the operating state amount detected by the pressure sensors and (Continued)

the temperature sensors, and comparing the calculated refrigerant amount with a reference refrigerant amount. The controller controls a quality of the refrigerant at an outlet of the liquid extension pipe to be in a range from 0.1 to 0.7 in the refrigerant-leakage detection operation.

17 Claims, 11 Drawing Sheets

(52) U.S. Cl.
CPC ..... *F24F 11/36* (2018.01); *F24F 2110/00* (2018.01); *F25B 2313/006* (2013.01); *F25B 2313/0233* (2013.01); *F25B 2313/02741* (2013.01); *F25B 2313/0314* (2013.01); *F25B 2313/0315* (2013.01); *F25B 2400/08* (2013.01); *F25B 2500/19* (2013.01); *F25B 2500/222* (2013.01); *F25B 2600/05* (2013.01); *F25B 2700/1931* (2013.01); *F25B 2700/1933* (2013.01); *F25B 2700/21151* (2013.01); *F25B 2700/21152* (2013.01)

(56) References Cited

U.S. PATENT DOCUMENTS 6,536,225 B1 * 3/2003 Yajima
2006/0042276 A1 * 3/2006 Doll, Jr. ..... F25B 49/005 62/129
2009/0126375 A1 * 5/2009 Toyoshima ..... F25B 45/00 62/77
2012/0006436 A1 * 1/2012 Morimoto ..... F16K 11/085 137/625
2012/0167601 A1 * 7/2012 Cogswell ..... F25B 1/10 62/115
2012/0260685 A1 * 10/2012 Honda ..... F24F 3/06 62/160
2012/0291462 A1 * 11/2012 Verma ..... F25B 40/00 62/115

FOREIGN PATENT DOCUMENTS

JP 2009-243793 10/2009
JP 4412385 B2 11/2009
JP 2010-002109 A 1/2010
JP 2010-007996 A 1/2010
JP 2011-064357 A 3/2011
JP 2011-106688 A 6/2011
JP 2011-226704 A 11/2011
JP 4975052 B2 4/2012
WO 2011/111114 A1 9/2011
WO 2012/114454 A1 8/2012

OTHER PUBLICATIONS

Extended European Search Report dated Feb. 7, 2017 in the corresponding European Patent Application No. 13 88 9063.7.
Japanese Office Action dated Oct. 4, 2016 in the corresponding JP application No. 2015-526059. (English translation attached).

* cited by examiner

REFRIGERATION CYCLE APPARATUS

CROSS REFERENCE TO RELATED APPLICATION

This application is a U.S. national stage application of International Application No. PCT/JP2013/068855 filed on Jul. 10, 2013, the disclosure of which is incorporated herein by reference.

TECHNICAL FIELD

The present invention relates to a refrigeration cycle apparatus.

BACKGROUND ART

Conventionally, for a separate refrigeration cycle apparatus (for example, a refrigerating and air-conditioning apparatus) in which an indoor unit and an outdoor unit are connected by a liquid extension pipe and a gas extension pipe, there is a technique that estimates a refrigerant-amount presence ratio in the refrigerating and air-conditioning apparatus with regard to the length of the liquid extension pipe by using information of, for example, a pressure sensor, a temperature sensor, and a liquid-level detection sensor required for operation of the refrigerating and air-conditioning apparatus, and detects leakage of the refrigerant based on the estimation result (for example, see Patent Literature 1).

CITATION LIST

Patent Literature

Patent Literature 1: Japanese Patent No. 4412385 (page 11, FIG. 1, etc.)

SUMMARY OF INVENTION

Technical Problem

In general, a liquid extension pipe through which two-phase refrigerant flows has a larger pipe diameter than the pipe diameter of a gas extension pipe to decrease a pressure loss. Also, in a large building or another construction, an outdoor unit and an indoor unit are arranged at positions far from each other. There are many liquid extension pipes having lengths of 100 m or larger. If the length of a liquid extension pipe is increased, the inner capacity of the liquid extension pipe is also increased. Hence, the ratio of the refrigerant amount in the liquid extension pipe with respect to the total refrigerant amount is increased.

To calculate the refrigerant amount in the liquid extension pipe, it is required to calculate the refrigerant density of the liquid extension pipe first. If the calculation result has an error, an error in the calculation result for the refrigerant amount in the liquid extension pipe obtained by the product of the refrigerant density of the liquid extension pipe and the inner capacity of the liquid extension pipe is also increased. In this case, the error significantly influences the calculation result for the total refrigerant amount, and hence refrigerant-leakage detection accuracy is decreased. Accordingly, increasing calculation accuracy of the refrigerant amount in the liquid extension pipe results in increasing the refrigerant-leakage detection accuracy.

Patent Literature 1 describes the necessity of considering the length of the liquid extension pipe when the refrigerant leakage is detected; however, Patent Literature 1 does not describe about the method of calculating the liquid-extension-pipe refrigerant density. Hence, there remains some doubt about the refrigerant-leakage detection accuracy.

The present invention is made in light of the situations, and an object of the present invention is to provide a refrigeration cycle apparatus that can correctly calculate the refrigerant amount in a liquid extension pipe and that can detect refrigerant leakage with high accuracy.

Solution to Problem

A refrigeration cycle apparatus according to the present invention includes a refrigerant circuit configured to circulate refrigerant to a compressor, a condenser, an expansion valve, and an evaporator, the compressor being connected to the condenser by a first extension pipe, the expansion valve being connected to the evaporator by a second extension pipe; a detection unit to detect an operating state amount of the refrigerant circuit; and a controller to execute refrigerant-leakage detection operation of detecting refrigerant leakage by calculating a refrigerant amount in the refrigerant circuit based on the operating state amount detected by the detection unit and comparing the calculated refrigerant amount with a reference refrigerant amount. The controller controls a quality of the refrigerant at an outlet of the second extension pipe to be in a range from 0.1 to 0.7 in the refrigerant-leakage detection operation.

Advantageous Effects of Invention

With the present invention, the refrigeration cycle apparatus that can correctly calculate the refrigerant amount in the second extension pipe through which the two-phase refrigerant flows and that can detect the refrigerant leakage with high accuracy can be provided.

DESCRIPTION OF EMBODIMENTS

Embodiment 1 and Embodiment 2 of the present invention are described below with reference to the drawings. Embodiment 1 and Embodiment 2 of refrigerating and air-conditioning apparatuses are described below as examples of refrigeration cycle apparatuses.

Embodiment 1

Figure 1:
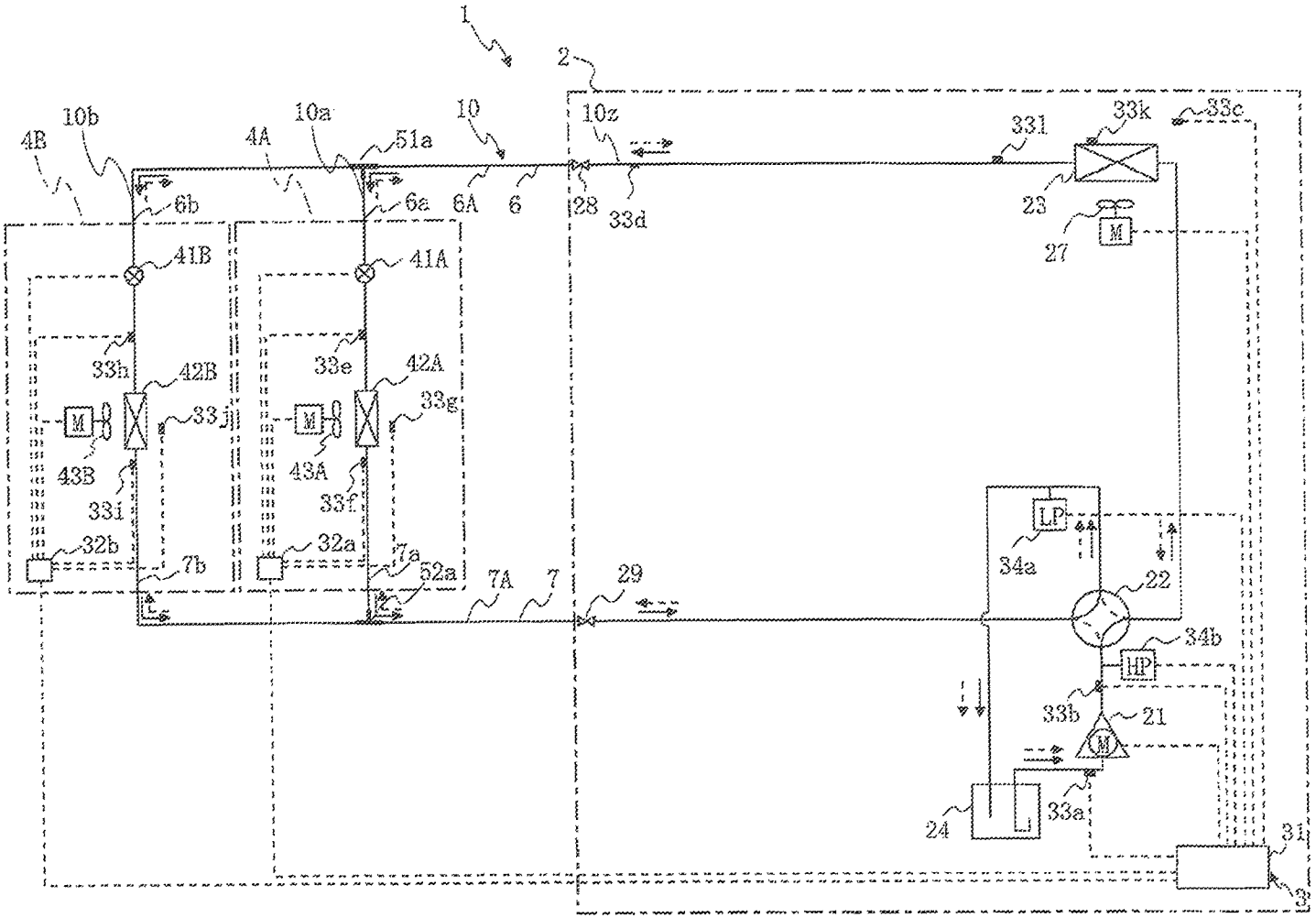
FIG. 1 is a schematic configuration diagram showing an example of a refrigerant circuit configuration of a refrigerating and air-conditioning apparatus 1 according to Embodiment 1 of the present invention.

FIG. 1 is a schematic configuration diagram showing an example of a refrigerant circuit configuration of a refrigerating and air-conditioning apparatus 1 according to Embodiment 1 of the present invention. With reference to FIG. 1, the refrigerant circuit configuration and operation of the refrigerating and air-conditioning apparatus 1 are described. The refrigerating and air-conditioning apparatus 1 is installed in, for example, a building or a condominium, and is used for cooling and heating an air-conditioned space in which the refrigerating and air-conditioning apparatus 1 is installed, by executing vapor-compressing refrigeration cycle operation. In the drawings including FIG. 1, the relationship among the sizes of respective components may be occasionally different from the actual relationship.

<Configuration of Refrigerating and Air-Conditioning Apparatus 1>

The refrigerating and air-conditioning apparatus 1 mainly includes an outdoor unit 2 serving as a heat source, and a plurality of (in FIG. 1, two) indoor units 4 (an indoor unit 4A and an indoor unit 4B) connected to the outdoor unit 2 in parallel and serving as use-side units. Also, the refrigerating and air-conditioning apparatus 1 includes extension pipes (a liquid extension pipe (a second extension pipe) 6 and a gas extension pipe (a first extension pipe 7)) that connect the outdoor unit 2 and each indoor unit 4. That is, the refrigerating and air-conditioning apparatus 1 includes a refrigerant circuit 10 in which the outdoor unit 2 and the indoor unit 4 are connected by the refrigerant pipes and through which refrigerant circulates. The liquid extension pipe 6 includes a liquid main extension pipe 6A, a liquid branch extension pipe 6*a*, a liquid branch extension pipe 6*b*, and a distributor 51*a*. Also, the gas extension pipe 7 includes a gas main extension pipe 7A, a gas branch extension pipe 7*a*, a gas branch extension pipe 7*b*, and a distributor 52*a*. In this case, R410A is used for the refrigerant.

[Indoor Unit 4]

The indoor unit 4A and the indoor unit 4B receive cooling energy or heating energy from the outdoor unit 2 and supply cooling air or heating air to the air-conditioned space. In the following description, the character "A" or "B" located at the end of the indoor unit 4 is occasionally omitted, and in that case, it is assumed that the reference sign 4 without A or B represents both the indoor unit 4A and the indoor unit 4B. Also, "A (or a)" is added to the end of the reference sign of each unit (including a portion of the circuit) in the system of the "indoor unit 4A," and "B (or b)" is added to the end of the reference sign of each unit (including a portion of the circuit) in the system of the "indoor unit 4B." In the description for such a unit, "A (or a)" or "B (or b)" at the end of the unit is occasionally omitted; however, it is obvious that the reference sign without A or B represents the units of both the indoor unit 4A and the indoor unit 4B.

The indoor unit 4 is installed, for example, by being concealed in the ceiling in a room, suspended from the ceiling, or hung on a wall surface in a room of a building or another construction. The indoor unit 4A is connected to the outdoor unit 2 with an extension by using the liquid main extension pipe 6A, the distributor 51*a*, the liquid branch extension pipe 6*a*, the gas branch extension pipe 7*a*, the distributor 52*a*, and the gas main extension pipe 7A. The indoor unit 4A configures a portion of the refrigerant circuit 10. The indoor unit 4B is connected to the outdoor unit 2 with an extension by using the liquid main extension pipe 6A, the distributor 51*a*, the liquid branch extension pipe 6*b*, the gas branch extension pipe 7*b*, the distributor 52*a*, and the gas main extension pipe 7A. The indoor unit 4B configures a portion of the refrigerant circuit 10.

The indoor unit 4 mainly includes an indoor-side refrigerant circuit (an indoor-side refrigerant circuit 10*a* and an indoor-side refrigerant circuit 10*b*) configuring a portion of the refrigerant circuit 10. The indoor-side refrigerant circuit mainly includes an expansion valve 41 serving as an expansion mechanism and an indoor heat exchanger 42 serving as a use-side heat exchanger with an extension in series.

The indoor heat exchanger 42 exchanges heat between a heat medium (for example, the air, water, or another medium) and refrigerant, and condenses and liquefies the refrigerant, or evaporates and gasifies the refrigerant. To be specific, the indoor heat exchanger 42 functions as a condenser (a radiator) for the refrigerant in heating operation to heat the indoor air, and functions as an evaporator for the refrigerant in cooling operation to cool the indoor air. The indoor heat exchanger 42 may be desirably configured of, for example, a cross-fin fin-and-tube heat exchanger including a heat transmission tube and many fins although the type of the indoor heat exchanger 42 is not particularly limited.

The expansion valve 41 is arranged at the liquid side of the indoor heat exchanger 42 and expands the refrigerant by reducing the pressure of the refrigerant to execute flow rate control or other control for the refrigerant flowing through the indoor-side refrigerant circuit. The expansion valve 41 is desirably configured of a valve whose opening degree can be controlled to be variable, for example, an electronic expansion valve.

The indoor unit 4 includes an indoor fan 43. The indoor fan 43 is an air-sending device that sucks the indoor air into the indoor unit 4, causes the indoor heat exchanger 42 to exchange heat with the refrigerant, and then supplies the indoor air as supply air to the indoor area. The amount of the air to be supplied from the indoor fan 43 to the indoor heat exchanger 42 is variable. For example, the indoor fan 43 is desirably configured of a centrifugal fan or a multi-blade fan driven by a DC fan motor. However, the indoor heat exchanger 42 may exchange heat with a heat medium (for example, water or brine) different from the refrigerant or the air.

Also, the indoor unit 4 includes various sensors. At the gas side of the indoor heat exchanger 42, a gas-side temperature sensor (a gas-side temperature sensor 33*f* (mounted in the indoor unit 4A), a gas-side temperature sensor 33*i* (mounted in the indoor unit 4B)) is provided. The gas-side temperature sensor detects a temperature of the refrigerant (that is, a refrigerant temperature corresponding to a condensing temperature Tc in heating operation or an evaporating temperature Te in cooling operation). At the liquid side of the indoor heat exchanger 42, a liquid-side temperature sensor (a liquid-side temperature sensor 33*e* (mounted in the indoor unit 4A), a liquid-side temperature sensor 33*h* (mounted in the indoor unit 4B)) is provided. The liquid-side temperature sensor detects a temperature Teo of the refrigerant.

Also, at the suction port side of the indoor air of the indoor unit 4, an indoor temperature sensor (an indoor temperature sensor 33*g* (mounted in the indoor unit 4A), an indoor temperature sensor 33*j* (mounted in the indoor unit 4B)) is provided. The indoor temperature sensor detects a temperature of the indoor air flowing into the unit (that is, an indoor temperature Tr). Information (temperature information) detected by these various sensors is sent to a controller (an indoor-side controller 32), described later. The controller controls operation of respective units mounted in the indoor unit 4. The information is used for operation control of the respective units. The types of the liquid-side temperature sensors 33*e* and 33*h*, the gas-side temperature sensors 33*f* and 33*i*, and the indoor temperature sensor 33*g* and 33*j* are not particularly limited; however, these sensors are desirably configured of, for example, thermistors.

Also, the indoor unit 4 includes an indoor-side controller 32 (32*a*, 32*b*) that controls operation of respective units configuring the indoor unit 4. Further, the indoor-side controller 32 includes a microcomputer, a memory, and other devices provided to execute the control of the indoor unit 4. The indoor-side controller 32 can transmit and receive control signals or other signals to and from a remote controller (not shown) for individually operating the indoor unit 4, and can transmit and receive control signals or other signals to and from the outdoor unit 2 (specifically, an outdoor-side controller 31) through a transmission line (or in a wireless manner). That is, the indoor-side controller 32 and the outdoor-side controller 31 cooperate with each other and hence function as a controller 3 that executes operation control of the entire refrigerating and air-conditioning apparatus 1 (see FIG. 2).

[Outdoor Unit 2]

The outdoor unit 2 has a function of supplying cooling energy or heating energy to the indoor unit 4. For example, the outdoor unit 2 is arranged outside a building or another construction, and the outdoor unit 2 is connected to the indoor unit 4 with an extension by using the liquid extension pipe 6 and the gas extension pipe 7. The outdoor unit 2 configures a portion of the refrigerant circuit 10. That is, the refrigerant flowing out from the outdoor unit 2 and flowing through the liquid main extension pipe 6A is divided into the liquid branch extension pipe 6*a* and the liquid branch extension pipe 6*b* through the distributor 51*a*, and flows into the corresponding indoor unit 4A and indoor unit 4B. Similarly, the refrigerant flowing out from the outdoor unit 2 and flowing through the gas main extension pipe 7A is divided into the gas branch extension pipe 7*a* and the gas branch extension pipe 7*b* through the distributor 52*a*, and flows into the corresponding indoor unit 4A and indoor unit 4B.

The outdoor unit 2 mainly includes an outdoor-side refrigerant circuit 10*z* configuring a portion of the refrigerant circuit 10. The outdoor-side refrigerant circuit 10*z* mainly has a configuration in which a compressor 21, a four-way valve 22 serving as a flow switching device, an outdoor heat exchanger 23 serving as a heat-source-side heat exchanger, an accumulator 24 serving as a liquid container, a liquid-side closing valve 28, and a gas-side closing valve 29 are arranged in series with an extension.

The compressor 21 brings the refrigerant into a high-temperature and high-pressure state by sucking the refrigerant and compressing the refrigerant. The operating capacity of the compressor 21 is variable. For example, the compressor 21 is desirably configured of a capacity compressor or another type of compressor driven by a motor with the frequency F controlled by an inverter. FIG. 1 illustrates an example in which the compressor 21 is a single compressor; however, it is not limited thereto. Two or more compressors 21 may be mounted in parallel with an extension in accordance with the number of extension indoor units 4.

The four-way valve 22 switches the flow direction of the refrigerant between a flow direction of the refrigerant in heating operation and a flow direction of the refrigerant in cooling operation. In cooling operation, the four-way valve 22 is switched so that an extension is provided between the discharge side of the compressor 21 and the gas side of the outdoor heat exchanger 23 and that the accumulator 24 is connected to the gas main extension pipe 7A side as indicated by solid lines. Accordingly, the outdoor heat exchanger 23 functions as a condenser for the refrigerant compressed by the compressor 21, and the indoor heat exchanger 42 functions as an evaporator. In heating operation, the four-way valve 22 is switched so that an extension is provided between the discharge side of the compressor 21 and the gas main extension pipe 7A and that an extension is provided between the accumulator 24 and the gas side of the outdoor heat exchanger 23 as indicated by broken lines. Accordingly, the indoor heat exchanger 42 functions as a condenser for the refrigerant compressed by the compressor 21, and the outdoor heat exchanger 23 functions as an evaporator.

The outdoor heat exchanger 23 exchanges heat between a heat medium (for example, the air, water, or another medium) and refrigerant, and condenses and liquefies the refrigerant, or evaporates and gasifies the refrigerant. To be specific, the outdoor heat exchanger 23 functions as an evaporator for the refrigerant in heating operation, and functions as a condenser (a radiator) for the refrigerant in cooling operation. The outdoor heat exchanger 23 may be desirably configured of, for example, a cross-fin fin-and-tube heat exchanger including a heat transmission tube and many fins although the type of the outdoor heat exchanger 23 is not particularly limited. The gas side of the outdoor heat exchanger 23 is connected to the four-way valve 22, and the liquid side of the outdoor heat exchanger 23 is connected to the liquid main extension pipe 6A.

The outdoor unit 2 includes an outdoor fan 27. The outdoor fan 27 is an air-sending device that sucks the outdoor air into the outdoor unit 2, causes the outdoor heat exchanger 23 to exchange heat with the refrigerant, and then discharges the air to the outdoor space. The amount of the air to be supplied from the outdoor fan 27 to the outdoor heat exchanger 23 is variable. For example, the outdoor fan 27 is desirably configured of a propeller fan or another fan driven by a DC fan motor. However, the outdoor heat exchanger 23 may exchange heat with a heat medium (for example, water or brine) different from the refrigerant or the air.

The accumulator 24 is connected between the four-way valve 22 and the compressor 21. The accumulator 24 is a container that can store excessive refrigerant generated in the refrigerant circuit 10 in accordance with a variation in operating load of the indoor unit 4. The liquid-side closing valve 28 and the gas-side closing valve 29 are provided at connection ports with respect to external units and pipes (specifically, the liquid main extension pipe 6A and the gas main extension pipe 7A), and allow and inhibit passage of the refrigerant therethrough.

Also, the outdoor unit 2 includes a plurality of pressure sensors and a plurality of temperature sensors. The pressure sensors include a suction pressure sensor 34*a* that detects a suction pressure $P_s$ of the compressor 21, and a discharge pressure sensor 34*b* that detects a discharge pressure $P_d$ of the compressor 21.

The temperature sensors included in the outdoor unit 2 include a suction temperature sensor 33*a*, a discharge temperature sensor 33*b*, a liquid pipe temperature sensor 33*d*, a heat exchange temperature sensor 33*k*, a liquid-side temperature sensor 33*l*, and an outdoor temperature sensor 33*c*. The suction temperature sensor 33*a* is provided between the accumulator 24 and the compressor 21, and detects a suction temperature $T_s$ of the compressor 21. The discharge temperature sensor 33*b* detects a discharge temperature $T_d$ of the compressor 21. The heat exchange temperature sensor 33*k* detects a temperature of the refrigerant flowing through the outdoor heat exchanger 23. The liquid-side temperature sensor 33*l* is arranged at the liquid side of the outdoor heat exchanger 23, and detects a refrigerant temperature at the liquid side. The outdoor temperature sensor 33*c* is arranged at the suction port side for the outdoor air of the outdoor unit 2, and detects a temperature of the outdoor air flowing into the outdoor unit 2.

Information (temperature information) detected by these various sensors is sent to a controller (the outdoor-side controller 31). The controller controls operation of respective units mounted in the indoor unit 4. The information is used for operation control of the respective units. The types of the respective temperature sensors are not particularly limited; however, these sensors are desirably configured of, for example, thermistors.

Also, the outdoor unit 2 includes the outdoor-side controller 31 that controls operation of respective elements configuring the outdoor unit 2. The outdoor-side controller 31 includes a microcomputer, a memory, an inverter circuit that controls a motor, and other elements provided to control the outdoor unit 2. Further, the outdoor-side controller 31 can transmit and receive control signals or other signals to and from the indoor-side controller 32 of the indoor unit 4 through a transmission line (or in a wireless manner). That is, the outdoor-side controller 31 and the indoor-side controller 32 cooperate with each other and hence function as the controller 3 that executes operation control of the entire refrigerating and air-conditioning apparatus 1 (see FIG. 2).

Figure 2:
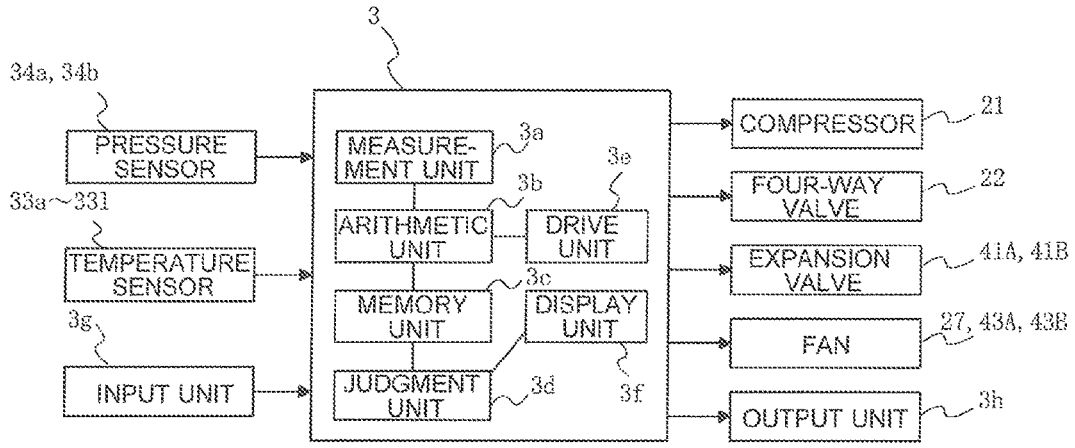
FIG. 2 is a control block diagram showing an electrical configuration of the refrigerating and air-conditioning apparatus 1 in FIG. 1.

The controller 3 is described in detail below. FIG. 2 is a control block diagram showing an electrical configuration of the refrigerating and air-conditioning apparatus 1 in FIG. 1.

The controller 3 is connected to the pressure sensors (the suction pressure sensor 34*a* and the discharge pressure sensor 34*b*) and the temperature sensors (the gas-side temperature sensors 33*f* and 33*i*, the liquid-side temperature sensors 33*e* and 33*h*, the indoor temperature sensors 33*g* and 33*j*, the suction temperature sensor 33*a*, the discharge temperature sensor 33*b*, the outdoor temperature sensor 33*c*, the liquid pipe temperature sensor 33*d*, the heat exchange temperature sensor 33*k*, and the liquid-side temperature sensor 33*l*) serving as detectors to be able to receive detection signals from the pressure sensors and the temperature sensors. Also, the controller 3 is connected to respective units to control the various units (the compressor 21, the four-way valve 22, the outdoor fan 27, the indoor fan 43, and the expansion valve 41 serving as a flow control valve) based on the detection signals from these sensors and other signals.

As shown in FIG. 2, the controller 3 includes a measurement unit 3*a*, an arithmetic unit 3*b*, a memory unit 3*c*, a judgment unit 3*d*, a drive unit 3*e*, a display unit 3*f*, an input unit 3*g*, and an output unit 3*h*. The measurement unit 3*a* has a function of measuring a pressure and a temperature (that is, an operating state amount) of the refrigerant circulating through the refrigerant circuit 10 based on the information sent from the pressure sensors and the temperature sensors. The arithmetic unit 3*b* has a function of performing arithmetic operation for a refrigerant amount (that is an operating state amount) based on the measurement value measured by the measurement unit 3*a*. The memory unit 3*c* has a function of storing the measurement value measured by the measurement unit 3*a* and the refrigerant amount calculated by the arithmetic operation of the arithmetic unit 3*b*, and storing information from an external device. The judgment unit 3*d* has a function of judging the presence of refrigerant leakage by comparing a reference refrigerant amount stored in the memory unit 3*c* and the refrigerant amount calculated by the arithmetic operation.

The drive unit 3*e* has a function of controlling drive of respective elements (specifically, a compressor motor, a valve mechanism, a fan motor, and other elements) that drive the refrigerating and air-conditioning apparatus 1. The display unit 3*f* has a function of notifying an external device about information indicative of a situation, such as completion of filling with the refrigerant or detection of refrigerant leakage if filling with the refrigerant is completed or the refrigerant leaks by voice or display, and notifying an external device about abnormality generated in operation of the refrigerating and air-conditioning apparatus 1. The input unit 3*g* has a function of inputting and changing set values for various control, and inputting external information such as a refrigerant filling amount. The output unit 3*h* has a function of outputting the measurement value measured by the measurement unit 3*a* and the value obtained by the arithmetic operation by the arithmetic unit 3*b* to an external device.

(Extension Pipe)

The extension pipes (the liquid extension pipe 6 and the gas extension pipe 7) connect the outdoor unit 2 to the indoor unit 4, and circulate the refrigerant in the refrigerating and air-conditioning apparatus 1. That is, the refrigerating and air-conditioning apparatus 1 forms the refrigerant circuit 10 by arranging the various units configuring the refrigerating and air-conditioning apparatus 1 with an extension by the extension pipes, and by circulating the refrigerant through the refrigerant circuit 10, cooling operation and heating operation can be executed.

As described above, the extension pipes include the liquid extension pipe 6 (the liquid main extension pipe 6A, the liquid branch extension pipe 6*a*, the liquid branch extension pipe 6*b*, and the distributor 51*a*) through which liquid refrigerant or two-phase refrigerant flows, and the gas extension pipe 7 (the gas main extension pipe 7A, the gas branch extension pipe 7*a*, the gas branch extension pipe 7*b*, and the distributor 52*a*) through which gas refrigerant flows. Among these pipes, the liquid main extension pipe 6A, the liquid branch extension pipe 6*a*, the liquid branch extension pipe 6*b*, the gas main extension pipe 7A, the gas branch extension pipe 7*a*, and the gas branch extension pipe 7*b* are refrigerant pipes that are constructed at an installation site when the refrigerating and air-conditioning apparatus 1 is installed at an installation position such as a building. For the respective pipes, pipes having pipe diameters determined in accordance with a combination of an outdoor unit 2 and an indoor unit 4 are used.

To be specific, the amount of refrigerant flowing through the main extension pipes (the liquid main extension pipe 6A and the gas main extension pipe 7A) is larger than the amount of refrigerant flowing through the branch extension pipes (the liquid branch extension pipe 6*a*, the liquid branch extension pipe 6*b*, the gas branch extension pipe 7*a*, and the gas branch extension pipe 7*b*) at each of the liquid side and the gas side. Also, since the gas refrigerant and the liquid refrigerant have different pressure losses, pressure losses generated in the respective extension pipes are different. The pipe diameters of the respective extension pipes are selected in accordance with the balance between the pressure losses and the cost. As described above, since the pipe diameters of the respective extension pipes are different, correctly calculating the inner capacities of the extension pipes is troublesome and very difficult.

Also, in a large-scale building or another construction, in many cases, the outdoor unit 2 is separated from the indoor unit 4 by a large distance. There may be many extension pipes with lengths of 100 m or larger, and many extension pipes with large capacities. Hence, as described above, the ratio of the refrigerant amount in the extension pipes with respect to the total refrigerant amount is large, and a calculation error of extension-pipe refrigerant density significantly influences the total refrigerant amount. Embodiment 1 has, even in this situations, features that can correctly calculate the refrigerant amount in the liquid extension pipe through which the two-phase refrigerant flows, and detect refrigerant leakage with high accuracy. The characteristics are successively described below.

Embodiment 1 uses the extension pipes including the distributor 51*a* and the distributor 52*a* for the connection between the single outdoor unit 2 and the two indoor units 4. However, the distributor 51*a* or the distributor 52*a* is not necessarily essential. Also, the shapes of the distributor 51*a* and the distributor 52*a* are desirably determined in accordance with the number of extension indoor units 4. For example, as shown in FIG. 1, the distributor 51*a* and the distributor 52*a* may be configured of T-shaped pipes or may be configured with use of headers. Also, if a plurality of (three or more) indoor units 4 are connected, the refrigerant may be distributed by using a plurality of T-shaped pipes, or the refrigerant may be distributed by using headers.

(Liquid-Level Detection Sensor)

A liquid-level detection sensor 35 is arranged inside or outside the accumulator 24. The liquid-level detection sensor 35 recognizes the liquid level of the liquid refrigerant stored in the accumulator 24, and recognizes the refrigerant amount in the accumulator 24 from the liquid level position. For a specific liquid-level detection sensor, there are various liquid-level detection systems including an outside installation type, such as a sensor using ultrasound or a sensor measuring a temperature, and an inside insertion type, such as a sensor using a float or a sensor using electrostatic capacity.

As described above, the indoor-side refrigerant circuit (the indoor-side refrigerant circuit 10*a* and the indoor-side refrigerant circuit 10*b*), the outdoor-side refrigerant circuit 10*z*, and the extension pipes are connected and thus the refrigerating and air-conditioning apparatus 1 is configured. The refrigerating and air-conditioning apparatus 1 operates by switching the four-way valve 22 in accordance with cooling operation or heating operation with the controller 3 configured of the indoor-side controller 32 and the outdoor-side controller 31, and controls the respective units mounted in the outdoor unit 2 and the indoor units 4 in accordance with the operating load of each indoor unit 4. However, the four-way valve 22 is not necessarily an essential configuration, and may be omitted.

<Operation of Refrigerating and Air-Conditioning Apparatus 1>

Operation of the respective elements of the refrigerating and air-conditioning apparatus 1 and refrigerant-leakage detection are described. The refrigerating and air-conditioning apparatus 1 controls the respective units configuring the refrigerating and air-conditioning apparatus 1 in accordance with the operating load of each indoor unit 4, and executes cooling and heating operation.

Figure 3:
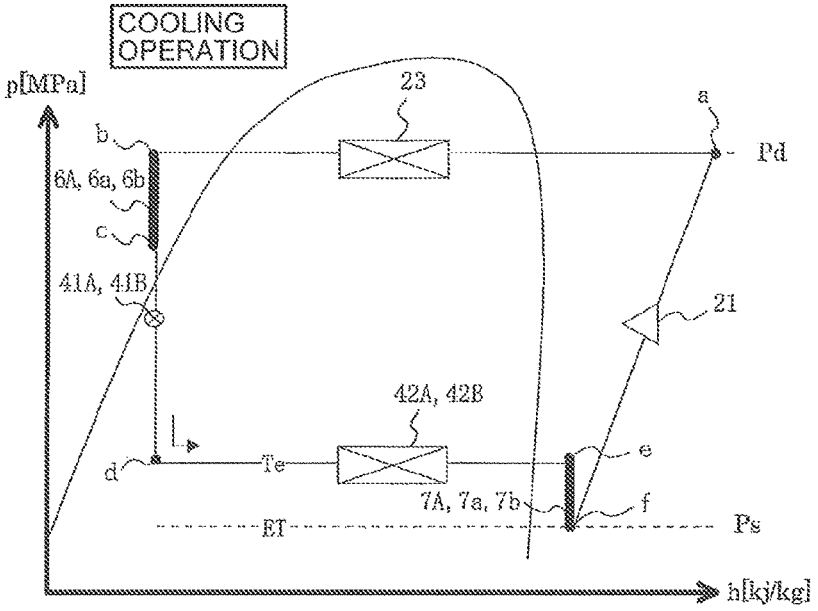
FIG. 3 is a p-h diagram in cooling operation of the refrigerating and air-conditioning apparatus 1 according to Embodiment 1 of the present invention.
Figure 4:
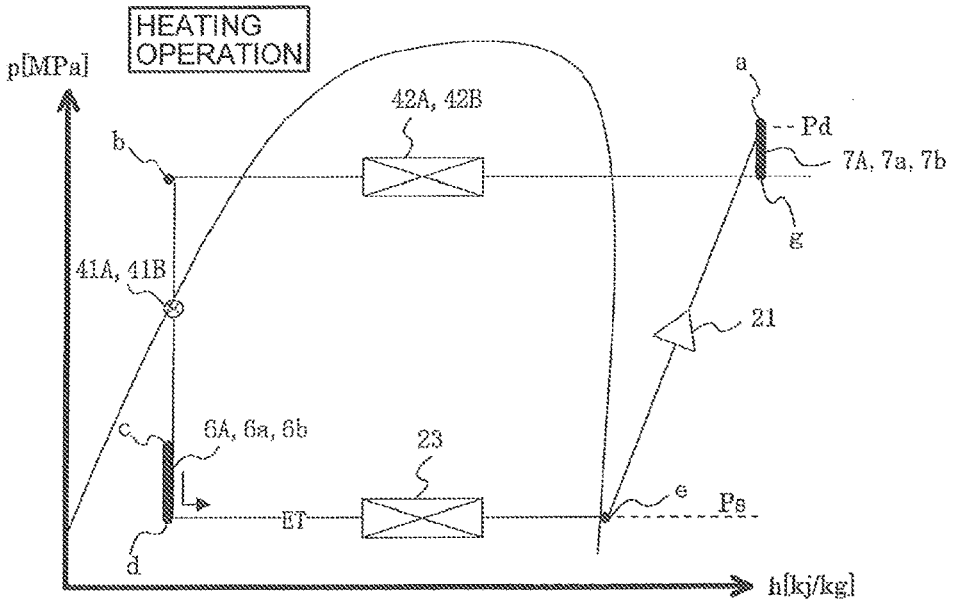
FIG. 4 is a p-h diagram in heating operation of the refrigerating and air-conditioning apparatus 1 according to Embodiment 1 of the present invention.

FIG. 3 is a p-h diagram in cooling operation of the refrigerating and air-conditioning apparatus 1 according to Embodiment 1 of the present invention. FIG. 4 is a p-h diagram in heating operation of the refrigerating and air-conditioning apparatus 1 according to Embodiment 1 of the present invention. In FIG. 1, the flow of the refrigerant in cooling operation is indicated by arrows of solid lines, and the flow of the refrigerant in heating operation is indicated by arrows of broken lines. Also, in the refrigerating and air-conditioning apparatus 1, refrigerant-leakage detection is constantly executed, and remote monitoring can be executed in a management center by using a communication line.

(Cooling Operation)

Cooling operation that is executed by the refrigerating and air-conditioning apparatus 1 is described with reference to FIGS. 1 and 3.

In cooling operation, the four-way valve 22 is controlled in a state indicated by solid lines in FIG. 1, and the refrigerant circuit becomes a connection state as follows. That is, the discharge side of the compressor 21 is connected to the gas side of the outdoor heat exchanger 23. Also, the suction side of the compressor 21 is connected to the gas side of the indoor heat exchanger 42 through the gas-side closing valve 29 and the gas extension pipe 7 (the gas main extension pipe 7A, the gas branch extension pipe 7*a*, and the gas branch extension pipe 7*b*). The liquid-side closing valve 28 and the gas-side closing valve 29 are in open state. Also, an example in which cooling operation is executed in all indoor units 4 is described.

Low-temperature and low-pressure refrigerant is compressed by the compressor 21, becomes high-temperature and high-pressure gas refrigerant, and is discharged (point a in FIG. 3). The high-temperature and high-pressure gas refrigerant discharged from the compressor 21 flows into the outdoor heat exchanger 23 through the four-way valve 22. The refrigerant flowing into the outdoor heat exchanger 23 is condensed and liquefied while transferring heat to the outdoor air by air-sending effect of the outdoor fan 27 (point b in FIG. 3). The condensing temperature at this time can be detected by the heat exchange temperature sensor 33*k* or obtained by converting the pressure detected by the discharge pressure sensor 34*b* into the saturation temperature.

Then, high-pressure liquid refrigerant flowing out from the outdoor heat exchanger 23 flows out from the outdoor unit 2 through the liquid-side closing valve 28. The pressure of the high-pressure liquid refrigerant flowing out from the outdoor unit 2 is decreased in the liquid main extension pipe 6A, the liquid branch extension pipe 6*a*, and the liquid branch extension pipe 6*b* due to friction with pipe wall surfaces (point c in FIG. 3). The refrigerant flows into the indoor unit 4. The pressure of the refrigerant is decreased by the expansion valve 41, and hence the refrigerant becomes low-pressure two-phase gas-liquid medium (point d in FIG. 3). The two-phase gas-liquid refrigerant flows into the indoor heat exchanger 42 functioning as an evaporator for the refrigerant, and receives heat from the air by air-sending effect of the indoor fan 43. Thus, the two-phase gas-liquid refrigerant is evaporated and gasified (point e in FIG. 3). At this time, cooling is executed in the air-conditioned space.

The evaporating temperature at this time is measured by the liquid-side temperature sensor 33*e* and the liquid-side temperature sensor 33*h*. Superheat degrees SH of the refrigerant at the outlet of the indoor heat exchanger 42A and the refrigerant at the outlet of the indoor heat exchanger 42B are obtained by subtracting refrigerant temperatures detected by the liquid-side temperature sensor 33*e* and the liquid-side temperature sensor 33*h* from refrigerant temperature values detected by the gas-side temperature sensor 33*f* and the gas-side temperature sensor 33*i*.

Also, in cooling operation, the opening degrees of the expansion valves 41A and 41B are controlled so that the superheat degrees SH of the refrigerant at the outlet of the indoor heat exchanger 42A and the refrigerant at the outlet of the indoor heat exchanger 42B (that is, at the gas side of the indoor heat exchanger 42A and the gas side of the indoor heat exchanger 42B) become a superheat degree target value SHm.

The gas refrigerant passing through the indoor heat exchanger 42 passes through the gas branch extension pipe 7*a*, the gas branch extension pipe 7*b*, and the gas main extension pipe 7A, and flows into the outdoor unit 2 through the gas-side closing valve 29. The pressure of the gas refrigerant is decreased due to friction with pipe wall surfaces when passing through the gas branch extension pipe 7*a*, the gas branch extension pipe 7*b*, and the gas main extension pipe 7A (point f in FIG. 3). Then, the refrigerant flowing into the outdoor unit 2 is sucked again into the compressor 21 through the four-way valve 22 and the accumulator 24. The refrigerating and air-conditioning apparatus 1 executes cooling operation in the flow described above.

(Heating Operation)

Heating operation that is executed by the refrigerating and air-conditioning apparatus 1 is described with reference to FIGS. 1 and 4.

In heating operation, the four-way valve 22 is controlled in a state indicated by broken lines in FIG. 1, and the refrigerant circuit becomes a connection state as follows. That is, the discharge side of the compressor 21 is connected to the gas side of the indoor heat exchanger 42 through the gas-side closing valve 29 and the gas extension pipe 7 (the gas main extension pipe 7A, the gas branch extension pipe 7*a*, and the gas branch extension pipe 7*b*). Also, the suction side of the compressor 21 is connected to the gas side of the outdoor heat exchanger 23. The liquid-side closing valve 28 and the gas-side closing valve 29 are in open state. Also, an example in which heating operation is executed in all indoor units 4 is described.

Low-temperature and low-pressure refrigerant is compressed by the compressor 21, becomes high-temperature and high-pressure gas refrigerant, and is discharged (point a in FIG. 4). The high-temperature and high-pressure gas refrigerant discharged from the compressor 21 flows out from the outdoor unit 2 through the four-way valve 22 and the gas-side closing valve 29. The high-temperature and high-pressure gas refrigerant flowing out from the outdoor unit 2 passes through the gas main extension pipe 7A, the gas branch extension pipe 7*a*, and the gas branch extension pipe 7*b*, and at this time the pressure of the refrigerant is decreased due to friction with pipe wall surfaces (point g in FIG. 4). This refrigerant flows into the indoor heat exchanger 42 of the indoor unit 4. The refrigerant flowing into the indoor heat exchanger 42 is condensed and liquefied while transferring heat to the indoor air by air-sending effect of the indoor fan 43 (point b in FIG. 4). At this time, heating is executed in the air-conditioned space.

The pressure of the refrigerant flowing out from the indoor heat exchanger 42 is decreased by the expansion valve 41, and hence the refrigerant becomes two-phase gas-liquid refrigerant with low pressure (point c in FIG. 4). At this time, the opening degrees of the expansion valves 41A and 41B are controlled so that subcooling degrees SC of the refrigerant at the outlet of the indoor heat exchanger 42A and the refrigerant at the outlet of the indoor heat exchanger 42B become constant at a subcooling degree target value SCm.

The subcooling degrees SC of the refrigerant at the outlet of the indoor heat exchanger 42A and the refrigerant at the outlet of the indoor heat exchanger 42B are obtained as follows. First, the discharge pressure $P_d$ of the compressor 21 detected by the discharge pressure sensor 34*b* is converted into a saturation temperature value corresponding to the condensing temperature Tc. Then, each of the refrigerant temperature values detected by the liquid-side temperature sensors 33*e* and 33*h* is subtracted from the saturation temperature value. Thus, the subcooling degrees SC are obtained. Alternatively, temperature sensors that detect the temperatures of refrigerant flowing through the respective indoor heat exchangers 42 may be additionally provided, and the subcooling degrees SC may be obtained by subtracting the refrigerant temperature values corresponding to the condensing temperatures Tc detected by the temperature sensors from the refrigerant temperature values detected by the liquid-side temperature sensor 33*e* and the liquid-side temperature sensor 33*h*.

Then, the two-phase gas-liquid refrigerant with low pressure passes through the liquid branch extension pipe 6*a*, the liquid branch extension pipe 6*b*, and the liquid main extension pipe 6A, the pressure of the refrigerant is decreased due to friction with pipe wall surfaces when passing through the liquid branch extension pipe 6*a*, the liquid branch extension pipe 6*b*, and the liquid main extension pipe 6A (point d in FIG. 4), and then the refrigerant flows into the outdoor unit 2 through the liquid-side closing valve 28. The refrigerant flowing into the outdoor unit 2 flows into the outdoor heat exchanger 23, and is evaporated and gasified by receiving heat from the outdoor air by air-sending effect of the outdoor fan 27 (point e in FIG. 4). Then, the refrigerant is sucked again into the compressor 21 through the four-way valve 22 and the accumulator 24. The refrigerating and air-conditioning apparatus 1 executes heating operation in the flow described above.

Cooling operation and heating operation are described above; however, the amounts of refrigerant required for respective operations are different. In Embodiment 1, the refrigerant amount in required cooling operation is larger than the refrigerant amount in required heating operation. This is because, since the expansion valve 41 is connected to the indoor unit 4 side, the refrigerant in the liquid extension pipe 6 is in liquid phase and the refrigerant in the gas extension pipe 7 is in gas phase in cooling operation; however, the refrigerant in the liquid extension pipe 6 is in two-phase and the refrigerant in the gas extension pipe 7 is in gas phase in heating operation. That is, at the gas extension pipe 7 side, the refrigerant is in gas phase in both cooling operation and heating operation, and therefore no difference is generated between heating operation and cooling operation. However, at the liquid extension pipe 6 side, the refrigerant is in liquid phase in cooling operation and the refrigerant is in two-phase in heating operation. The refrigerant amount in liquid phase state is larger than that in two-phase. Consequently the refrigerant is required by a larger amount in cooling operation than heating operation.

Also, a phenomenon that an evaporator average refrigerant density is smaller than a condenser average refrigerant density and a phenomenon that the inner capacities of the outdoor heat exchanger 23 and the indoor heat exchanger 42 are different from each other also relate to that the required refrigerant amounts are different depending on the operating state. To be more specific, the inner capacity of the indoor heat exchanger 42 is smaller than that of the outdoor heat exchanger 23 in relation to the installation space and design. Accordingly, the outdoor heat exchanger 23 having the larger inner capacity serves as a condenser with a large average refrigerant density in cooling operation, and hence the outdoor heat exchanger 23 requires a large refrigerant amount. In contrast, the outdoor heat exchanger 42 having the smaller inner capacity serves as a condenser with a large average refrigerant density in heating operation, and hence the indoor heat exchanger 42 does not require a large refrigerant amount.

Therefore, in the refrigerating and air-conditioning apparatus 1, when cooling operation and heating operation are executed by switching the four-way valve 22, the refrigerant amount required for cooling operation differs from the refrigerant amount required for heating operation. In such a case, the refrigerant is filled by an amount to meet the operating state of cooling operation that requires the large refrigerant amount, and in heating operation that does not require the large refrigerant amount, the excessive liquid refrigerant is stored in the accumulator 24 or another container.

<Method of Performing Arithmetic Operation for Refrigerant Amount>

Next, a method of calculating the filling amount of refrigerant charged to the refrigerating and air-conditioning apparatus 1 is described with reference to an example in heating operation. A calculated refrigerant amount $M_r$ [kg] is obtained as a sum total of the refrigerant amounts of the respective elements configuring the refrigerant circuit obtained from the operating states of the elements. The sum total is obtained as follows.

[Math. 1]

$$M_r = \Sigma V \times \rho = M_{rc} + M_{rPL} + M_{rPC} + M_{re} + M_{rACC} + M_{rOIL} + M_{rADD} \quad (1)$$

It is assumed that a major portion of the refrigerant is present in an element with a large inner capacity V [$m^3$] or an element with a high average refrigerant density ρ [kg/$m^3$](described later), and refrigerating machine oil (the refrigerant being dissolved in the refrigerating machine oil). Based on this assumption, the refrigerant amount is calculated. An element with a high average refrigerant density ρ mentioned here represents an element through which refrigerant with high pressure, or refrigerant in two-phase or in liquid phase passes In Embodiment 1, the calculated refrigerate amount $M_r$ [kg] is obtained with regard to the outdoor heat exchanger 23, the liquid extension pipe 6, the indoor heat exchanger 42, the gas extension pipe 7, the accumulator 24, and the refrigerating machine oil present in the refrigerant circuit. The calculated refrigerant amount $M_r$ is expressed by the sum total of the products of the inner capacities V of the respective elements and the average refrigerant density ρ as expressed by Expression (1).

The refrigerant amounts M of the respective elements in Expression (1) are written below Expression (1).

This expression includes values as follows.

$M_{rc}$: condenser refrigerant amount $M_{rPL}$: liquid-extension-pipe refrigerant amount $M_{rPG}$: gas-extension-pipe refrigerant amount $M_{re}$: evaporator refrigerant amount $M_{rAcc}$: accumulator refrigerant amount $M_{rOIL}$: oil dissolved refrigerant amount $M_{rADD}$: additional refrigerant amount Methods of calculating the refrigerant amounts of the respective elements are successively described below.

(1) Calculation of Refrigerant Amount $M_{rc}$ of Indoor Heat Exchanger (Condenser) 42

Figure 5:
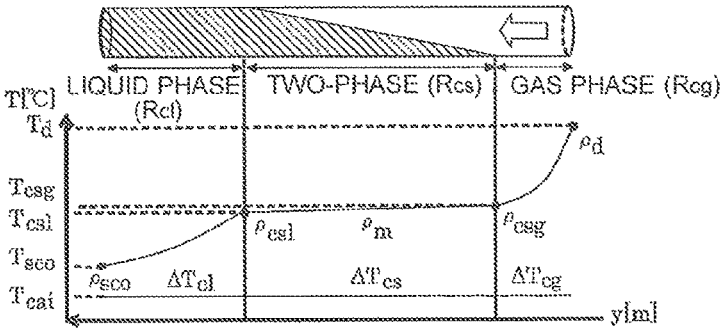
FIG. 5 is an explanatory view of a refrigerant state in a condenser.

FIG. 5 is an explanatory view of the refrigerant state in the condenser. At the condenser inlet, the degree of superheat at the discharge side of the compressor 21 is larger than 0 degrees, and hence the refrigerant is in gas phase. Also, at the condenser outlet, the degree of subcooling is larger than 0 degrees, and hence the refrigerant is in liquid phase. In the condenser, the refrigerant in gas phase state at the temperature $T_d$ is cooled by the indoor air at a temperature $T_{cai}$, and becomes saturated vapor at a temperature $T_{csg}$. Then, the saturated vapor is further cooled by the indoor air at the temperature $T_{cai}$, is condensed by a change in latent heat in two-phase state, and becomes saturated liquid at a temperature $T_{csl}$. Then, the saturated liquid is further cooled, and becomes liquid phase state at a temperature $T_{sco}$.

The condenser refrigerant amount $M_{rc}$ [kg] is expressed by the following expression.

[Math. 2]

$$M_{rc} = V_c \times \rho_c \quad (2)$$

This expression includes values as follows.

$V_c$: condenser inner capacity [$m^3$]

$\rho_c$: average refrigerant density [kg/$m^3$] of condenser $V_c$ is a device specification, and hence is a known value. $\rho_c$ [kg/$m^3$] is expressed by the following expression.

[Math. 3]

$$\rho_c = R_{cg} \times \rho_{cg} = + R_{cs} \times \rho_{cs} + R_{cl} \times \rho_{cl} \quad (3)$$

This expression includes values as follows.

$R_{cg}$: capacity ratio [-] in gas phase region $R_{cs}$: capacity ratio [-] in two-phase region $R_{cl}$: capacity ratio [-] in liquid phase region $\rho_{cg}$: average refrigerant density [kg/m$^3$] in gas phase region $\rho_{cs}$: average refrigerant density [kg/m$^3$] in two-phase region $\rho_{cl}$: average refrigerant density [kg/m$^3$] in liquid phase region As found from the above expression, to calculate the average refrigerant density $\rho_c$ of the condenser, it is required to calculate the capacity ratios and the average refrigerant densities in the respective phase regions.

First, a method of calculating the average refrigerant density in each phase region is described.

(1.1) Calculation of Average Refrigerant Densities in Gas Phase Region, Two-Phase Region, and Liquid Phase Region of Condenser (a) Calculation of Average Refrigerant Density $\rho_{cg}$ in Gas Phase Region The gas-phase-region average refrigerant density $\rho_{cg}$ in the condenser is obtained, for example, by using the average value of a condenser inlet density $\rho_d$ [kg/m$^3$] and a saturated vapor density $\rho_{csg}$ [kg/m$^3$] in the condenser as expressed in the following expression.

[Math. 4]

$$\rho_{cg} = \frac{\rho_d + \rho_{csg}}{2} \quad (4)$$

The condenser inlet density $\rho_d$ can be obtained by arithmetic operation by using a condenser inlet temperature (corresponding to the discharge temperature $T_d$) and a pressure (corresponding to the discharge pressure $P_d$). Also, the saturated vapor density $\rho_{csg}$ in the condenser can be obtained by arithmetic operation by using a condensing pressure (corresponding to the discharge pressure $P_d$).

(b) Calculation of Average Refrigerant Density $\rho_{cl}$ in Liquid Phase Region The liquid-phase-region average refrigerant density $\rho_{cl}$ is obtained, for example, by using the average value of an outlet density $\rho_{sco}$ [kg/m$^3$] of the condenser and a saturated liquid density $\rho_{csl}$ [kg/m$^3$] in the condenser as shown in the following expression.

[Math. 5]

$$\rho_{cl} = \frac{\rho_{sco} + \rho_{csl}}{2} \quad (5)$$

The outlet density $\rho_{sco}$ of the condenser can be obtained by arithmetic operation by using the condenser outlet temperature $T_{sco}$ and a pressure (corresponding to the discharge pressure $P_d$). Also, the saturated liquid density $\rho_{csl}$ in the condenser can be obtained by arithmetic operation by using a condensing pressure (corresponding to the discharge pressure $P_d$).

(b) Calculation of Average Refrigerant Density $\rho_{cs}$ in Two-Phase Region

The two-phase-region average refrigerant density $\rho_{cs}$ in the condenser is expressed by the following expression if it is assumed that the heat flux is constant in two-phase region.

[Math. 6]

$$\rho_{cs} = \int_0^1 [f_{cg} \times \rho_{csg} + (1 - f_{cg}) \times \rho_{csl}] dx \quad (6)$$

This expression includes values as follows.

x [-]: quality of refrigerant $f_{cg}$ [-]: void fraction in condenser

The void fraction $f_{cg}$ is expressed by the following expression.

[Math. 7]

$$f_{cg} = \frac{1}{1 + \left(\frac{1}{x} - 1\right)\frac{\rho_{csg}}{\rho_{csl}} s} \quad (7)$$

In this expression, s [-] is a slip ratio (a speed ratio of gas and liquid). For an arithmetic expression of the slip ratio s, there are suggested many experimental expressions. The slip ratio s is expressed as a function of a mass flux $G_{mr}$ [kg/(m$^2$s)], a condensing pressure (corresponding to the discharge pressure $P_d$), and a quality x.

[Math. 8]

$$s = f(G_{mr}, P_d, x) \quad (8)$$

The mass flux $G_{mr}$ changes in accordance with the operating frequency of the compressor 21. Hence, by calculating the slip ratio s with this method, a change in calculated refrigerant amount $M_r$ with respect to the operating frequency of the compressor 21 can be detected.

The mass flux $G_{mr}$ can be obtained from the refrigerant flow rate in the condenser.

In the above-described process, the average refrigerant densities $\rho_{cg}$, $\rho_{cs}$, and $\rho_{cl}$ [kg/(m$^3$)] respectively in gas phase region, two-phase region, and liquid phase region required for calculating the average refrigerant density of the condenser are calculated.

The refrigerating and air-conditioning apparatus 1 of Embodiment 1 includes the outdoor heat exchanger (heat-source-side heat exchanger) 23, the indoor heat exchanger (use-side heat exchanger) 42, and the refrigerant flow rate arithmetic unit that performs arithmetic operation for the refrigerant flow rate. The refrigerant flow rate arithmetic unit can detect a change in calculated refrigerant amount $M_r$ with respect to the refrigerant flow rate by using the slip ratio s.

(1.2) Calculation of Capacity Ratios in Gas Phase, Two-Phase, and Liquid Phase of Condenser Next, a method of calculating the capacity ratio in each phase region is described. The capacity ratio is expressed by a ratio of heat transfer areas, and hence the following expression is established.

[Math. 9]

$$R_{cg} : R_{cs} : R_{cl} = \frac{A_{cg}}{A_c} : \frac{A_{cs}}{A_c} : \frac{A_{cl}}{A_c} \quad (9)$$

This expression includes values as follows.

$A_{cg}$ [m$^2$]: gas-phase-region heat transfer area in condenser $A_{cs}$ [m$^2$]: two-phase-region heat transfer area in condenser $A_{cl}$ [m$^2$]: liquid-phase-region heat transfer area in condenser $A_c$ [m$^2$]: heat transfer area of entire condenser Also, if ΔH [kJ/kg] is a specific enthalpy difference between the inlet refrigerant and the outlet refrigerant in each region of gas phase region, two-phase region, and liquid phase region in the condenser, and $\Delta T_m$ [degrees C.] is an average temperature difference between the refrigerant and a medium that exchanges with heat with the refrigerant, the following expression is established in each phase region according to heat balance.

[Math. 10]

$$G_r \times \Delta H = AK\Delta T_m \tag{10}$$

This expression includes values as follows.

$G_r$ [kg/h]: mass flow rate of refrigerant

A [$m^2$]: heat transfer area

K [kW/($m^2$ degrees C.)]: heat passage rate

If it is assumed that the heat passage rate K in each phase region is constant, the capacity ratio is proportional to the value obtained by dividing the specific enthalpy difference $\Delta H$ [kJ/kg] by a temperature difference $\Delta T$ [degrees C.] between the refrigerant and the indoor air.

However, depending on an air-speed distribution, the amount in liquid phase region at a position at which the air blows differs from the amount in liquid phase region at a position at which the air does not blow, in each path of the heat exchanger configuring the condenser. That is, the amount in liquid phase region is decreased at the position at which the air does not blow and the amount in liquid phase region is increased at the position at which the air likely blows because heat transfer is promoted. Also, depending on a variation in distribution of the refrigerant to respective paths, it may be conceived that the refrigerant is unevenly distributed. Owing to this, when the capacity ratio of each phase region is calculated, the liquid phase region portion is multiplied by a condenser liquid-phase-region ratio correction coefficient $\alpha$ [-] and hence the aforementioned phenomenon is corrected. With the above-described configuration, the following expression is derived.

[Math. 11]

$$R_{cg}:R_{cs}:R_{cl} = \frac{\Delta H_{cg}}{\Delta T_{cg}}:\frac{\Delta H_{cs}}{\Delta T_{cs}}:\alpha\frac{\Delta H_{cl}}{\Delta T_{cl}} \tag{11}$$

This expression includes values as follows.

$\Delta H_{cg}$: specific enthalpy difference [kJ/kg] of refrigerant in gas phase region $\Delta H_{cs}$: specific enthalpy difference [kJ/kg] of refrigerant in two-phase region $\Delta H_{cl}$: specific enthalpy difference [kJ/kg] of refrigerant in liquid phase region $\Delta T_{cg}$: average temperature difference [degrees C.] between refrigerant and indoor air in gas phase region $\Delta T_{cs}$: average temperature difference [degrees C.] between refrigerant and indoor air in two-phase region $\Delta T_{cl}$: average temperature difference [degrees C.] between refrigerant and indoor air in liquid phase region Also, the condenser liquid-phase-region ratio correction coefficient $\alpha$ is a value obtained by using measurement data, and is a value different depending on the unit specification, in particular, the condenser specification.

By using the condenser liquid-phase-region ratio correction coefficient $\alpha$, the ratio of the refrigerant in liquid phase region present in the condenser can be corrected from the operating state amount of the condenser.

$\Delta H_{cg}$ is obtained by subtracting a specific enthalpy of saturated vapor from a specific enthalpy at the condenser inlet (corresponding to a discharge specific enthalpy of the compressor 21). The discharge specific enthalpy is obtained by arithmetically operating the discharge pressure $P_d$ and the discharge temperature $T_d$. The specific enthalpy of saturated vapor in the condenser can be obtained by arithmetic operation by using the condensing pressure (corresponding to the discharge pressure $P_d$).

Also, $\Delta H_{cs}$ is obtained by subtracting a specific enthalpy of saturated liquid in the condenser from the specific enthalpy of the saturated vapor in the condenser. The specific enthalpy of the saturated liquid in the condenser can be obtained by arithmetic operation by using the condensing pressure (corresponding to the discharge pressure $P_d$).

Also, $\Delta H_{cl}$ is obtained by subtracting a specific enthalpy at the condenser outlet from the specific enthalpy of the saturated liquid in the condenser. The specific enthalpy at the condenser outlet is obtained by arithmetically operating the condensing pressure (corresponding to the discharge pressure $P_d$) and the condenser outlet temperature $T_{sco}$.

The temperature difference $\Delta T_{cg}$ [degrees C.] between the refrigerant in gas phase region in the condenser and the outdoor air is expressed by the following expression as a logarithmic average temperature difference by using a condenser inlet temperature (corresponding to the discharge temperature $T_d$), the saturated vapor temperature $T_{csg}$ [degrees C.] in the condenser, and the inlet temperature $T_{cai}$ [degrees C.] of the indoor air.

[Math. 12]

$$\Delta T_{cg} = \frac{(T_d - T_{ca}) - (T_{csg} - T_{ca})}{\ln\frac{(T_d - T_{ca})}{(T_{csg} - T_{ca})}} \tag{12}$$

The saturated vapor temperature $T_{csg}$ in the condenser can be obtained by arithmetic operation by using the condensing pressure (corresponding to the discharge pressure $P_d$). The average temperature difference $\Delta T_{cs}$ between the refrigerant in two-phase region and the indoor air is expressed by the following expression by using the saturated vapor temperature $T_{csg}$ and the saturated liquid temperature $T_{csl}$ in the condenser.

[Math. 13]

$$\Delta T_{cs} = \frac{T_{csg} + T_{csl}}{2} - T_{ca} \tag{13}$$

The saturated liquid temperature $T_{csl}$ in the condenser can be obtained by arithmetic operation by using the condensing pressure (corresponding to the discharge pressure $P_d$). The average temperature difference $\Delta T_{cl}$ between the refrigerant in liquid phase region and the indoor air is expressed by the following expression as a logarithmic average temperature difference by using the condenser outlet temperature $T_{sco}$, the saturated liquid temperature $T_{csl}$ in the condenser, and the inlet temperature $T_{cai}$ of the indoor air.

[Math. 14]

$$\Delta T_{cl} = \frac{(T_{csl} - T_{ca}) - (T_{sco} - T_{ca})}{\ln\frac{(T_{csl} - T_{ca})}{(T_{sco} - T_{ca})}} \tag{14}$$

With these values, the average refrigerant densities $\rho_{cg}$, $\rho_{cs}$, and $\rho_{cl}$ in respective phase regions and the capacity ratio ($R_{cg}$:$R_{cs}$:$R_{cl}$) can be calculated. Hence the average refrigerant density $\rho_c$ of the condenser can be calculated. Accordingly, the condenser refrigerant amount $M_{rc}$ [kg] can be calculated by using Expression (2) described above.

(2) Calculation of Refrigerant Amounts $M_{rPL}$ and $M_{rPG}$ of Extension Pipes The liquid-extension-pipe refrigerant amount $M_{rPL}$ [kg] and a gas-extension-pipe refrigerant amount $M_{rPG}$ [kg] can be expressed by the respective following expressions.

[Math. 15]

$$M_{rPL}=V_{PL}\times\rho_{PL} \tag{15}$$

[Math. 16]

$$M_{rPG}=V_{PG}\times\rho_{PG} \tag{16}$$

This expression includes values as follows.

$\rho_{PL}$ [kg/m$^3$]: liquid-extension-pipe average refrigerant density $\rho_{PG}$ [kg/m$^3$]: gas-extension-pipe average refrigerant density $V_{PL}$ [m$^3$]: liquid-extension-pipe inner capacity $V_{PG}$ [m$^3$]: gas-extension-pipe inner capacity In heating operation, since the refrigerant in the liquid extension pipe 6 is in two-phase gas-liquid state, the liquid-extension-pipe average refrigerant density $\rho_{PL}$ [kg/m$^3$] can be expressed by the following expression by using an evaporator inlet quality $x_{ei}$ [-].

[Math. 17]

$$\rho_{PL}=\rho_{esg}\times X_{ei}+\rho_{esi}\times(1-X_{ei}) \tag{17}$$

[Math. 18]

$$X_{ei}=\frac{H_{ei}-H_{esi}}{H_{esg}-H_{esi}} \tag{18}$$

This expression includes values as follows.

$\rho_{esg}$ [kg/m$^3$]: saturated vapor density in evaporator $\rho_{es;}$ [kg/m$^3$]: saturated liquid density in evaporator $H_{esg}$ [kJ/kg]: saturated-vapor specific enthalpy in evaporator.

$H_{esl}$ [kJ/kg]: saturated-liquid specific enthalpy in evaporator.

$H_{ei}$ [kJ/kg]: evaporator inlet specific enthalpy $\rho_{esg}$ and $\rho_{esi}$ can be obtained by arithmetic operation by using the evaporating pressure (corresponding to the suction pressure $P_s$). $H_{esg}$ and $H_{esl}$ can be obtained by arithmetically operating the evaporating pressure (corresponding to the suction pressure $P_s$). Also, $H_{ei}$ can be obtained by arithmetic operation by using the condenser outlet temperature $T_{sco}$.

The gas-extension-pipe average refrigerant density $\rho_{PG}$ is obtained, for example, by calculating the gas-extension-pipe outlet temperature (corresponding to the suction temperature $T_s$) and the gas-extension-pipe outlet pressure (corresponding to the suction pressure $P_s$).

The gas-extension-pipe inner capacity $V_{PG}$ and the liquid-extension-pipe inner capacity $V_{PL}$ can be acquired in case of new installation. Also, the gas-extension-pipe inner capacity $V_{PG}$ and the liquid-extension-pipe inner capacity $V_{PL}$ can be acquired also in case that installation information in the past is saved. However, if the installation information in the past is deleted, the gas-extension-pipe inner capacity $V_{PG}$ and the liquid-extension-pipe inner capacity $V_{PL}$ cannot be acquired. That is, there are two cases that the gas-extension-pipe inner capacity $V_{PG}$ and the liquid-extension-pipe inner capacity $V_{PL}$ are known or unknown.

Also, the pipe lengths of the liquid extension pipe 6 and the gas extension pipe 7 can be acquired in case of new installation. Also, the pipe lengths of the liquid extension pipe 6 and the gas extension pipe 7 can be acquired also in case that installation information in the past is saved. However, if the installation information in the past is deleted, the information on the pipe lengths cannot be acquired. That is, there are two cases that the pipe lengths of the liquid extension pipe 6 and the gas extension pipe 7 are known or unknown.

If the information on the pipe lengths cannot be acquired, the pipe lengths are calculated as follows.

In this case, if it is assumed that the liquid extension pipe 6 and the gas extension pipe 7 have the same pipe length L [m], the pipe length L [m] can be calculated by the following expression.

[Math. 19]

$$L=\frac{M_{r1}-M_{r2}}{A_{PL}\times\rho_{PL}+A_{PG}\times\rho_{PG}} \tag{19}$$

This expression includes values as follows.

$M_{r1}$ [kg]: proper refrigerant amount $M_{r2}$ [kg]: refrigerant amount excluding liquid extension pipe 6 and gas extension pipe 7

$A_{PL}$ [m$^2$]: cross-sectional area of liquid extension pipe 6

$A_{PG}$ [m$^2$]: cross-sectional area of gas extension pipe 7

$M_{r1}$, $A_{PL}$, and $A_{PG}$ are known. $M_{r1}$ is calculated from the pipe length, the capacity of the configuration unit, and other measures, after installation of the refrigeration cycle apparatus at the installation site, and previously stored in the memory unit 3*c*. $M_{r2}$ is obtained by executing test operation after the device is installed and using the operating state amount of the refrigerant circuit. Accordingly, the pipe length L can be calculated by the above expression. Then, by using the pipe length L, the cross-sectional area $A_{PL}$ of the liquid extension pipe 6, and the cross-sectional area $A_{PG}$ of the gas extension pipe 7, the liquid-extension-pipe inner capacity $V_{PL}$ and the gas-extension-pipe inner capacity $V_{PG}$ can be calculated.

Also, the average refrigerant density $\rho_{PL}$ of the liquid extension pipe 6 is calculated as the liquid-extension-pipe outlet density by using the low pressure and the condenser outlet enthalpy.

If the correct inner capacities of the main extension pipes (the liquid main extension pipe 6A and the gas main extension pipe 7A) and the branch extension pipes (the liquid branch extension pipes 6*a* and 6*b*, and the gas branch extension pipes 7*a* and 7*b*) are uncertain, the refrigerant amount in each element cannot be correctly calculated. Hence, an error may be consequently generated when the total refrigerant amount is calculated.

In particular, in the liquid extension pipe 6 in which the refrigerant state is in two-phase state in heating operation, a change in refrigerant density with respect to a change in pressure is large. Hence, a refrigerant-amount calculation error due to a liquid-extension-pipe inlet/outlet pressure loss is increased.

Overview of Features of Embodiment 1

Accordingly, in Embodiment 1, to decrease a calculation error of the liquid-extension-pipe refrigerant amount $M_{rPL}$, operation is executed so that the liquid-extension-pipe inlet/outlet density difference is decreased when the refrigerant amount is calculated. Also, by executing operation so that the refrigerant density $\rho_{PL}$ itself in the liquid extension pipe 6 is decreased in advance, the influence of the refrigerant-density calculation error of the liquid extension pipe 6 on the calculation result of the total refrigerant amount is decreased. With such operation, even if an additional sensor, such as a pressure sensor or a temperature sensor, is not arranged, and even if the ratio of the respective inner capacities of the main extension pipes and the branch extension pipes is uncertain, the liquid-extension-pipe refrigerant amount $M_{rPL}$ can be calculated with high accuracy. The details of such operation are described later.

(3) Calculation of Refrigerant Amount $M_{re}$ of Outdoor Heat Exchanger (Evaporator) 23

Figure 6:
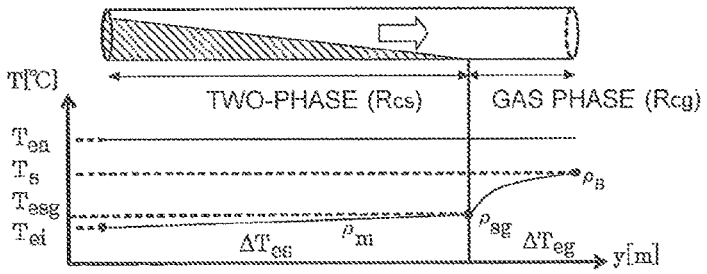
FIG. 6 is an explanatory view of a refrigerant state in an evaporator.

FIG. 6 is an explanatory view of the refrigerant state in the evaporator. At the evaporator inlet the refrigerant is in two-phase. At the evaporator outlet, the degree of superheat at the suction side of the compressor 21 is larger than 0 degrees, and hence the refrigerant is in gas phase. At the evaporator inlet, the refrigerant in two phase state at a temperature $T_{ei}$ [degrees C.] is heated by the indoor suction air at a temperature $T_{ea}$ [degrees C.], and becomes saturated vapor at a temperature of $T_{esg}$ [degrees C.]. This saturated vapor is further heated and becomes gas phase at the temperature $T_s$[degrees C.]. The evaporator refrigerant amount $M_{re}$ [kg] is expressed by the following expression.

[Math. 20]

$$M_{re}=V_e\times\rho_e \tag{20}$$

This expression includes values as follows.

$V_e$[m$^3$]: evaporator inner capacity $\rho_e$: evaporator average refrigerant density [kg/m$^3$]

The evaporator inner capacity $V_e$ is a device specification, and hence is known. $\rho_e$ is expressed by the following expression.

[Math. 21]

$$\rho_e=R_{es}\times\rho_{es}+R_{eg}\times\rho_{eg} \tag{21}$$

This expression includes values as follows.

$R_{es}$ [-]: capacity ratio in two-phase region $R_{eg}$ [-]: capacity ratio in gas phase region $\rho_{es}$ [kg/m$^3$]: average refrigerant density in two-phase region $\rho_{eg}$ [kg/m$^3$]: average refrigerant density in gas phase region As found from the above expression, to calculate the average refrigerant density $\rho_e$ of the evaporator, it is required to calculate the capacity ratios and the average refrigerant densities in the respective phase regions.

First, a method of calculating the average refrigerant density is described. A two-phase-region average refrigerant density pes in the evaporator is expressed by the following expression if it is assumed that the heat flux is constant in two-phase region.

[Math. 22]

$$\rho_{es}=\int_{xei}^{1}[f_{eg}\times\rho_{esg}+(1-f_{eg})\times\rho_{esl}]dx \tag{22}$$

This expression includes values as follows.

x [-]: quality of refrigerant $f_{eg}$ [-]: void fraction in evaporator

The void fraction $f_{eg}$ is expressed by the following expression.

[Math. 23]

$$f_{eg}=\frac{1}{1+\left(\frac{1}{x}-1\right)\frac{\rho_{esg}}{\rho_{esl}}s} \tag{23}$$

In this expression, s [-] is the slip ratio (the speed ratio of gas and liquid) as described above. For the arithmetic expression of the slip ratio s, there are suggested many experimental expressions. The slip ratio s is expressed as a function of the mass flux $G_{mr}$ [kg/(m$^2$s)], the condensing pressure (corresponding to the discharge pressure $P_d$), and the quality x.

[Math. 24]

$$s=f(G_{mr},P_s,x) \tag{24}$$

The mass flux $G_{mr}$ changes in accordance with the operating frequency of the compressor 21. Hence, by calculating the slip ratio s with this method, the change in calculated refrigerant amount $M_r$ with respect to the operating frequency of the compressor 21 can be detected.

The mass flux $G_{mr}$ can be obtained from the refrigerant flow rate in the evaporator.

The gas-phase-region average refrigerant density $\rho_{eg}$ in the evaporator is obtained, for example, by using the average value of the saturated vapor density $\rho_{esg}$ in the evaporator and the evaporator outlet density $\rho_s$ [kg/m$^3$] as expressed by the following expression.

[Math. 25]

$$\rho_{eg}=\frac{\rho_{esg}+\rho_s}{2} \tag{25}$$

The saturated vapor density $\rho_{esg}$ in the evaporator can be obtained by arithmetic operation by using the evaporating pressure (corresponding to the suction pressure $P_s$). The evaporator outlet density (corresponding to the suction density $\rho_s$) can be obtained by arithmetic operation by using the evaporator outlet temperature (corresponding to the suction temperature $T_s$) and the evaporator outlet pressure (corresponding to the suction pressure $P_s$).

Next, a method of calculating the capacity ratio in each phase region is described. The capacity ratio is expressed by a ratio of heat transfer areas, and hence the following expression is established.

[Math. 26]

$$R_{es}:R_{eg}=\frac{A_{es}}{A_e}:\frac{A_{eg}}{A_e} \tag{26}$$

This expression includes values as follows.

$A_{es}$ [m$^2$]: two-phase-region heat transfer area in evaporator $A_{eg}$ [m$^2$]: gas-phase-region heat transfer area in evaporator $A_e$ [m$^2$]: heat transfer area of entire evaporator Also, if $\Delta H$ is a specific enthalpy difference between the inlet refrigerant and the outlet refrigerant in each region of two-phase region and liquid phase region, and $\Delta T_m$ is an average temperature difference between the refrigerant and a medium that exchanges heat with the refrigerant, the following expression is established in each phase region according to heat balance.

[Math. 27]

$$G_r \times \Delta H = AK\Delta T_{es} \tag{27}$$

This expression includes values as follows.

$G_r$ [kg/h]: mass flow rate of refrigerant

A [$m^2$]: heat transfer area

K [kW/($m^2$ degrees C.)]: heat passage rate

If it is assumed that the heat passage rate K in each phase region is constant, the capacity ratio is proportional to the value obtained by dividing the specific enthalpy difference ΔH [kJ/kg] by a temperature difference ΔT [degrees C.] between the refrigerant and the outdoor air. The following expression is established.

[Math. 28]

$$R_{es}:R_{eg} = \frac{\Delta H_{es}}{\Delta T_{es}}:\frac{\Delta H_{eg}}{\Delta T_{eg}} \tag{28}$$

This expression includes values as follows.

$\Delta H_{es}$ [kJ/kg]: specific enthalpy difference of refrigerant in two-phase region $\Delta H_{eg}$ [kJ/kg]: specific enthalpy difference of refrigerant in gas phase region $\Delta T_{es}$ [degrees C.]: average temperature difference between refrigerant and outdoor air in two-phase region $\Delta T_{eg}$ [degrees C.]: average temperature difference between refrigerant and outdoor air in gas phase region $\Delta H_{es}$ is obtained by subtracting an evaporator inlet specific enthalpy from a saturated-vapor specific enthalpy in the evaporator. The specific enthalpy of the saturated vapor in the evaporator can be obtained by arithmetically operating the evaporating pressure (corresponding to the suction pressure $P_s$), and the evaporator inlet specific enthalpy can be obtained by arithmetic operation by using the condenser outlet temperature $T_{sco}$.

Also, $\Delta H_{eg}$ is obtained by subtracting the specific enthalpy of the saturated vapor in the evaporator from an evaporator outlet specific enthalpy (corresponding to a suction specific enthalpy). The evaporator outlet specific enthalpy can be obtained by arithmetically operating the outlet temperature (corresponding to the suction temperature $T_s$) and the outlet pressure (corresponding to the suction pressure $P_s$).

The average temperature difference $\Delta T_{es}$ between the two phase region in the evaporator and the outdoor air is expressed by the following expression.

[Math. 29]

$$\Delta T_{es} = T_{ea} - \frac{T_{esg} + T_{ei}}{2} \tag{29}$$

The saturated vapor temperature $T_{esg}$ in the evaporator is obtained by arithmetically operating the evaporating pressure (corresponding to the suction pressure $P_s$). The evaporator inlet temperature $T_{ei}$ is obtained by arithmetic operation by using the evaporating pressure (corresponding to the suction pressure $P_s$) and the inlet quality $x_{ei}$ in the evaporator. The average temperature difference $\Delta T_{eg}$ between the refrigerant in gas phase region and the outdoor air is expressed by the following expression as a logarithmic average temperature difference.

[Math. 30]

$$\Delta T_{eg} = \frac{(T_{cg} - T_{csg}) - (T_{cg} - T_{cg})}{\ln\frac{(T_{ca} - T_{csg})}{(T_{ea} - T_{eg})}} \tag{30}$$

The evaporator outlet temperature $T_{eg}$ is obtained as the suction temperature $T_s$.

With these values, the average refrigerant density $\rho_{cs}$ in two-phase region, the average refrigerant density $\rho_{cg}$ in gas phase region, and the inner capacity ratio ($R_{cg}$:$R_{cs}$) can be calculated, and the evaporator average refrigerant density $\rho_e$ can be calculated. Accordingly, the evaporator refrigerant amount $M_{re}$ [kg] can be calculated by using Expression (20) described above.

(4) Calculation of Accumulator Refrigerant Amount $M_{rACC}$

If the degrees of superheat at the inlet and outlet of the accumulator 24 is larger than 0 degrees, the inside of the accumulator 24 contains the gas refrigerant. As described above, if the inside of the accumulator 24 contains the gas refrigerant, the accumulator refrigerant amount $M_{rAcc}$ [kg] is expressed by the following expression.

[Math. 31]

$$M_{rACC} = V_{ACC} \times \rho_{ACC} \tag{31}$$

This expression includes values as follows.

$V_{ACC}$ [$m^3$]: accumulator inner capacity $\rho_{ACC}$ [kg/$m^3$]: accumulator average refrigerant density The accumulator inner capacity $V_{ACC}$ is a known value. The accumulator average refrigerant density $\rho_{ACC}$ is obtained by arithmetically operating an accumulator inlet temperature (corresponding to the suction temperature $T_s$) and an accumulator inlet pressure (corresponding to the suction pressure $P_s$).

If the degrees of superheat are zero at the inlet and outlet of the accumulator 24, such as in heating operation in Embodiment 1, the liquid refrigerant is present in the accumulator 24. If the accumulator 24 contains the liquid refrigerant, the accumulator refrigerant amount $M_{rACC}$ [kg] is expressed by the following expression.

[Math. 32]

$$M_{rACC} = (V_{ACC_L} \times \rho_{ACC_L}) + ((V_{ACC} - V_{ACC_L}) \times \rho_{ACC_0}) \tag{32}$$

This expression includes values as follows.

$V_{ACC_L}$ [$m^3$]: volume of liquid refrigerant stored in accumulator $\rho_{ACC_L}$ [kg/$m^3$]: liquid refrigerant density in accumulator $\rho_{ACC_G}$ [kg/$m^3$]: gas refrigerant density in accumulator The volume $V_{ACC_L}$ of the liquid refrigerant stored in the accumulator 24 is calculated by using the liquid-level detection sensor 35. Also, $\rho_{ACC_L}$ [kg/$m^3$] can be calculated as the density of the saturated liquid refrigerant with the inlet pressure (corresponding to the suction pressure $P_s$). The gas refrigerant density $\rho_{ACC_G}$ in the accumulator 24 can be calculated as the density of the saturated gas refrigerant with the inlet pressure (corresponding to the suction pressure $P_s$).

(5) Calculation of Oil Dissolved Refrigerant Amount $M_{rOIL}$ Dissolved in Refrigerating Machine Oil The oil dissolved refrigerant amount $M_{rOIL}$ [kg] dissolved in the refrigerating machine oil is expressed by the following expression.

[Math. 33]

$$M_{rOIL} = V_{OIL} \times \rho_{OIL} \times \frac{\phi_{OIL}}{(1-\phi_{OIL})} \quad (33)$$

This expression includes values as follows.

$V_{OIL}$ [m$^3$]: volume of refrigerating machine oil present in refrigerant circuit $\rho_{OIL}$ [kg/m$^3$]: density of refrigerating machine oil $\phi_{OIL}$ [-]: solubility of refrigerant to oil The volume $V_{OIL}$ of the refrigerating machine oil present in the refrigerant circuit is a device specification, and hence is known. If a major portion of the refrigerating machine oil is present in the compressor 21 and the accumulator 24, the refrigerating machine oil $\rho_{OIL}$ is handled as a constant value. Also, the solubility $\phi$ [-] of the refrigerant to the refrigerating machine oil is obtained by arithmetically operating the suction temperature $T_s$ and the suction pressure $P_s$ as expressed in the following expression.

[Math. 34]

$$\phi_{OIL}=f(T_s,P_s) \quad (34)$$

(6) Calculation of Liquid-Phase-Region Capacity/Initially Sealed Refrigerant Correction Amount (Hereinafter, Referred to as Additional Refrigerant Amount) $M_{rADD}$ However, if the liquid refrigerant is present in an unexpected element, such as a pipe that connects elements, the liquid refrigerant may influence the accuracy of the calculated refrigerant amount $M_r$. Also, when the refrigerant circuit is filled with the refrigerant, if a calculation error when the proper refrigerant amount is calculation or a filling work error is present, a difference is generated between the initially sealed refrigerant amount being the refrigerant amount actually filled at the installation site and the proper refrigerant amount. Hence, an additional refrigerant amount $M_{rADD}$ [kg] expressed by the following expression is added when the calculated refrigerant amount $M_r$ is calculated with Expression (1), and liquid-phase-region capacity/initially sealed refrigerant-amount correction is executed.

[Math. 35]

$$M_{rADD}=\beta\times\mu_l \quad (35)$$

This expression includes values as follows.

$\beta$ [m$^3$]: liquid-phase-region capacity/initially sealed refrigerant-amount correction coefficient $\rho_l$ [kg/m$^3$]: liquid-phase-region refrigerant density $\beta$ is obtained from actual device measurement data. $\rho_l$ is assumed as a condenser outlet density $\rho_{sco}$ in Embodiment 1. The condenser outlet density $\rho_{sco}$ is obtained by arithmetically operating the condenser outlet pressure (corresponding to the discharge pressure $P_d$) and the condenser outlet temperature $T_{sco}$.

The liquid-phase-region capacity/initially sealed refrigerant-amount correction coefficient $\beta$ varies depending on the device specifications. However, since the difference of the initially sealed refrigerant amount with respect to the proper refrigerant amount is corrected, the liquid-phase-region capacity/initially sealed refrigerant-amount correction coefficient $\beta$ is required to be determined every time when the device is charged with the refrigerant.

Alternatively, a liquid-phase-region capacity/initially sealed refrigerant-amount correction coefficient may be $\beta 1$ obtained as described below. For example, if the inner capacity of the liquid extension pipe 6 or the gas extension pipe 7 is large, the liquid-phase-region capacity/initially sealed refrigerant-amount correction coefficient $\beta 1$ is expressed by the following expression according to the extension pipe specification (the specification of the liquid extension pipe 6 or the gas extension pipe 7).

[Math. 36]

$$\beta 1 = \frac{(M_{r1}-M_r)\cdot(V_{PL}+V_{PG})}{\rho_{PL1}V_{PL}+\rho_{PG1}V_{PG}} \quad (36)$$

This expression includes values as follows.

$V_{PL}$ [m$^3$]: liquid-extension-pipe inner capacity $V_{PG}$ [m$^3$]: gas-extension-pipe inner capacity $M_{r1}$ [kg]: initially sealed refrigerant amount $\rho_{PL1}$ [kg/m$^3$]: average refrigerant density with proper refrigerant amount in liquid extension pipe $\rho_{PG1}$ [kg/m$^3$]: average refrigerant density with proper refrigerant amount in gas extension pipe $V_{PL}$ and $V_{PG}$ are obtained from the pipe length L as described above. If $V_{PL}$ and $V_{PG}$ are known values, the values may be used. $\rho_{PL1}$ and $\rho_{PG1}$ are obtained from measurement data.

The liquid-phase-region capacity/initially sealed refrigerant-amount correction when $\beta 1$ is used for the liquid-phase-region capacity/initially sealed refrigerant-amount correction coefficient is expressed by the following expression.

[Math. 37]

$$M_{rADD} = \beta 1 \frac{\rho_{PL}A_{PL}+\rho_{PG}A_{PG}}{(A_{PL}+A_{PG})} \quad (37)$$

By adding $M_{rADD}$ calculated by Expression (35) or Expression (37) to Expression (1), the liquid-phase-region capacity/initially sealed refrigerant-amount correction can be executed.

As described above, (1) the condenser refrigerant amount $M_{rc}$, (2) the liquid-extension-pipe refrigerant amount $M_{rPL}$ and the gas-extension-pipe refrigerant amount $M_{rPG}$, (3) the evaporator refrigerant amount $M_{re}$, (4) the accumulator refrigerant amount $M_{rACC}$, (5) the oil dissolved refrigerant amount $M_{rOIL}$, and (6) the additional refrigerant amount $M_{rADD}$ can be calculated. By adding these respective refrigerant amounts, the calculated refrigerant amount $M_r$ can be obtained.

Also, a refrigerant leakage rate r can be obtained by the following expression.

[Math. 38]

$$r = \frac{M_{r1}-M_r}{M_{r1}} \times 100 \quad (38)$$

<Influence of Liquid Refrigerant-Amount Correction on Calculated Refrigerant Amount>

When the calculated refrigerant amount $M_r$ is obtained, two corrections of the condenser liquid phase region ratio correction and the liquid phase region capacity/initially sealing refrigerant-amount correction are executed in Embodiment 1. Now, FIG. 7 shows a conceptual diagram for the influence of the correction on the calculated refrigerant amount.

Figure 7:
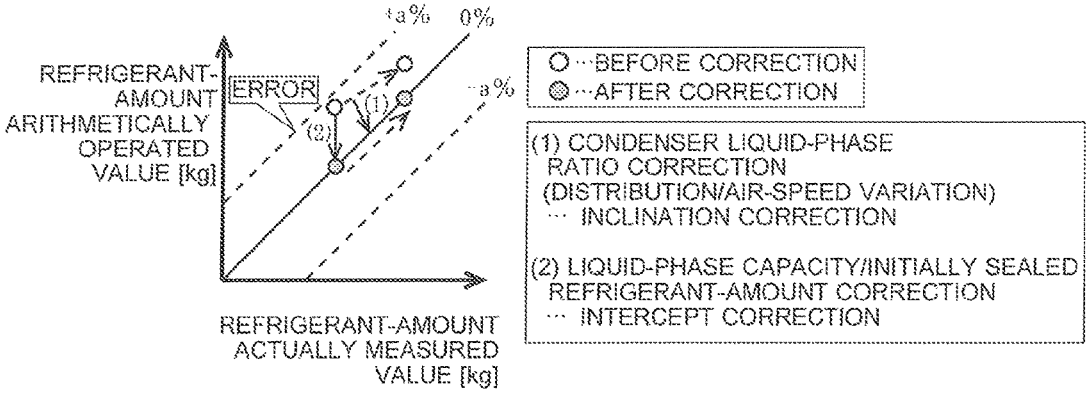
FIG. 7 is a conceptual diagram of an influence on arithmetic for a refrigerant amount by correction according to Embodiment 1 of the present invention.

FIG. 7 is a conceptual diagram of the influence on the arithmetic operation for the refrigerant amount by the correction according to Embodiment 1 of the present invention.

As the refrigerant amount is increased, the degree of subcooling at the condenser outlet is increased, and the liquid refrigerant amount in the condenser is increased. It can be understood that, by executing the condenser liquid-phase-region ratio correction, the change in liquid refrigerant amount in the condenser with respect to the refrigerant amount is increased. Also, it can be understood that, by executing the liquid-phase-region capacity/initially sealed refrigerant-amount correction, the refrigerant in liquid phase not considered before the correction is added.

<Influence of Compressor Frequency on Refrigerant-Amount Calculation Accuracy>

Now, the refrigerant distribution in the heat exchanger when the compressor frequency is decreased is described. If the compressor frequency is decreased, the calculation accuracy of the amount of refrigerant stored in the heat exchanger is degraded. This is because the refrigerant is influenced by pressure heads at the upper and lower sides of the heat exchanger, the liquid refrigerant stays in a lower portion of the heat exchanger, and hence the path balance between the upper and lower sides of the heat exchanger is degraded.

If the path balance is degraded, the actual refrigerant state does not meet the above-described refrigerant-amount calculation model (that is, the refrigerant-amount calculation model not considering the influence of the path balance). Accordingly, the refrigerant-amount calculation accuracy is degraded. Regarding these phenomena, to increase the accuracy of the refrigerant-amount calculation of the condenser, the compressor frequency is required to be as high as possible. By increasing the compressor frequency, a pressure loss of the difference between the heads of the heat exchanger is generated. The influence of the difference between the heads is unlikely provided, uniform distribution can be provided, the path balance is improved, and the refrigerant-amount calculation accuracy is increased.

(Regarding Liquid-Extension-Pipe Refrigerant-Amount Calculation Error)

When the unit (the refrigerating and air-conditioning apparatus) is configured, and when the number of pressure sensors and the number of temperature sensors are decreased for decreasing the cost, the liquid-extension-pipe outlet density is estimated by using the low pressure $P_s$ and the condenser outlet enthalpy, and the estimated value is represented as a liquid-extension pipe density. However, since a pressure loss is generated in the liquid extension pipe 6, the density at the inlet differs from the density at the outlet. Hence, an error is generated between the calculated liquid-extension pipe density and the actual liquid-extension pipe density.

Also, if a sensor is added and the inlet and outlet states of the liquid extension pipe are figured out, the refrigerant-amount calculation accuracy is increased as compared with the above-described case with the reduced number of sensors. However, since the correct densities of the liquid main extension pipe 6A and the liquid branch extension pipe 6*a* are uncertain and the correct inner capacities of the liquid main extension pipe 6A and the liquid branch extension pipe 6*a* are uncertain, an error is generated between the actual liquid-extension-pipe refrigerant amount and the estimated value.

Features of Embodiment 1

(Method of Decreasing Liquid-Extension-Pipe Refrigerant-Amount Calculation Error)

If the density difference between the inlet and outlet of the liquid extension pipe 6 is eliminated or minimized, the aforementioned problem relating to the uncertain inner capacities of the liquid main extension pipe 6A and the liquid branch extension pipe 6*a* becomes negligible. The refrigerant-amount calculation error can be decreased without the installation of the additional sensor.

Also, if the refrigerant density of the liquid extension pipe 6 is decreased and the refrigerant amount in the liquid extension pipe 6 is decreased in advance, the ratio of the refrigerant amount of the liquid extension pipe 6 with respect to the total refrigerant amount is decreased. Accordingly, the influence of the refrigerant-amount calculation error generated at the liquid extension pipe 6 on the calculation of the total calculated refrigerant amount $M_r$ can be decreased, and consequently the calculation accuracy of the calculated refrigerant amount $M_r$ can be increased.

Next, specific methods of decreasing the liquid-extension-pipe inlet/outlet density difference and decreasing the liquid-extension-pipe refrigerant density are described with reference to FIGS. 8 to 12.

Figure 8:
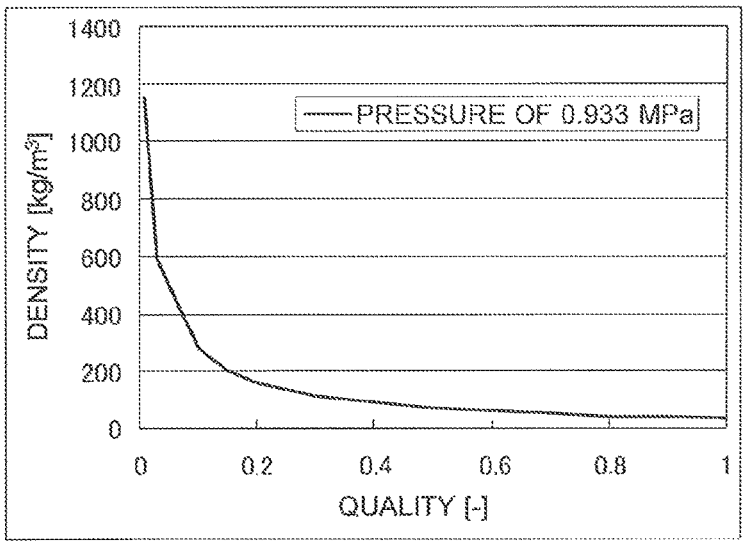
FIG. 8 is an illustration showing the relationship between the quality and the refrigerant density when the refrigerant is R410A and the pipe pressure is 0.933 [MPa].

FIG. 8 is an illustration showing the relationship between the quality and the refrigerant density when the refrigerant is R410A and the pipe pressure is 0.933 [MPa].

As shown in FIG. 8, the tendency of the refrigerant density is markedly changed around a quality of 0.1. The change in refrigerant density with respect to the quality is large with a quality lower than 0.1, and the change in refrigerant density with respect to the quality is small with a quality of 0.1 or higher. Regarding these phenomena, the liquid-extension-pipe refrigerant density can be decreased by controlling the quality at the outlet of the liquid extension pipe 6 to be 0.1 or larger. In this case, the pipe pressure is set at 0.933; however, this is merely an example. Even if the pipe pressure is different, it is still effective to set the liquid-extension-pipe outlet quality at 0.1 or larger.

Figure 9:
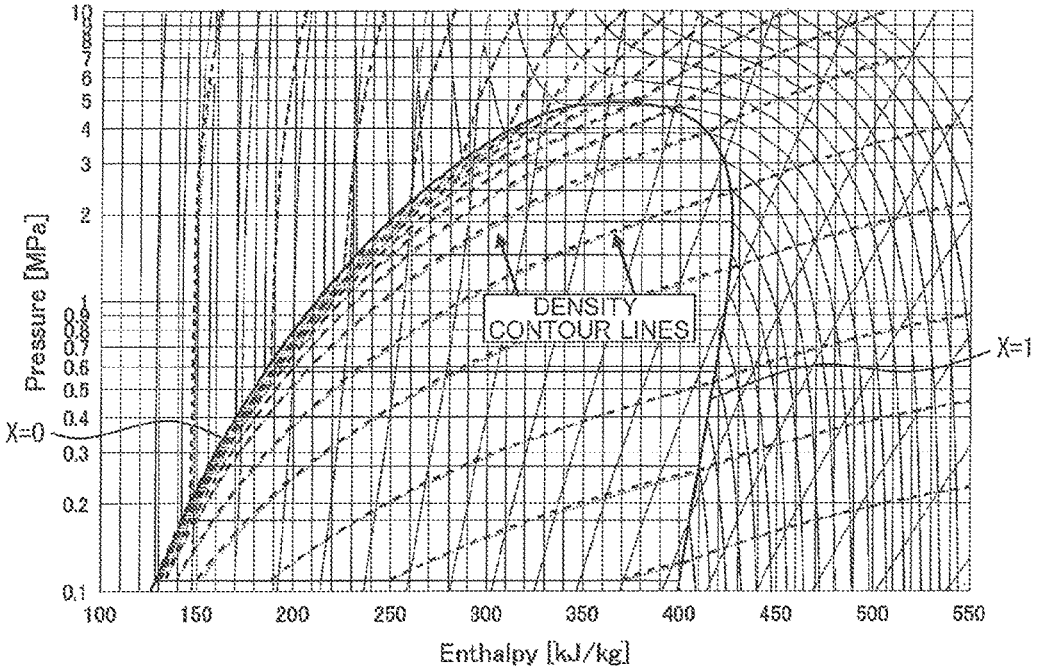
FIG. 9 is a P-h diagram with the refrigerant R410A.

FIG. 9 is a P-h diagram with the refrigerant R410A. In FIG. 9, broken lines indicate density contour lines. Also, FIG. 9 shows the quality x.

As shown in FIG. 9, if the quality is low (0.1 or lower), the intervals of the density contour lines are small. As the quality x is increased, the intervals of the density contour lines are increased. Regarding these phenomena, if the quality is 0.1 or lower with the intervals of the density contour lines decreased, it is found that the change amount of the refrigerant density by the change in enthalpy with the same pressure is increased. Other refrigerants also exhibit tendencies similar to the above tendency. Accordingly, without limiting to the pipe pressure being 0.933 [MPa], setting the liquid-extension-pipe outlet quality at 0.1 or higher is effective to increase the calculation accuracy of the calculated refrigerant amount $M_r$ even with other pipe pressures and for other refrigerants.

Figure 10:
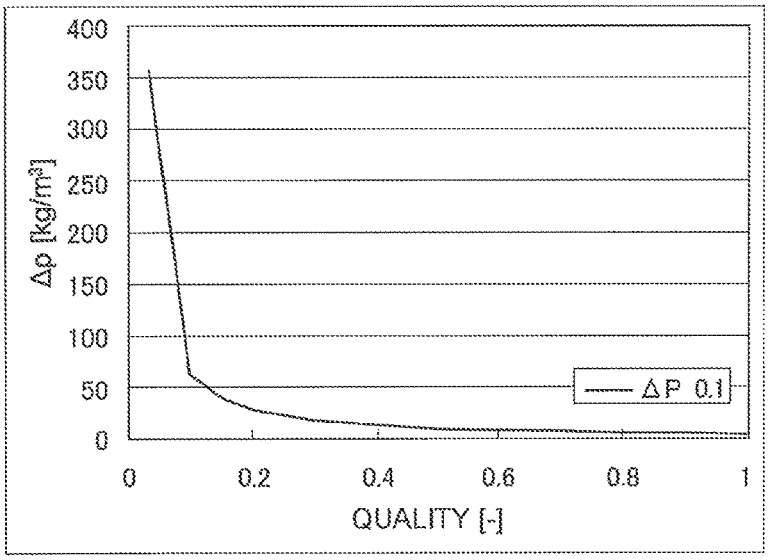
FIG. 10 is an illustration showing the relationship between the liquid-extension-pipe outlet quality and the liquid-extension-pipe inlet/outlet refrigerant density difference $\Delta\rho$ [kg/m$^3$] with the refrigerant R410A.

FIG. 10 is an illustration showing the relationship between the liquid-extension-pipe outlet quality and the liquid-extension-pipe inlet/outlet refrigerant density difference $\Delta\rho$ [kg/m$^3$] with the refrigerant R410A. FIG. 10 is an illustration when the liquid-extension-pipe inlet pressure is 0.933 [MPa], the liquid-extension-pipe outlet pressure is 0.833 [MPa], and the liquid-extension-pipe pressure loss $\Delta P$ is 0.1 [MPa].

The tendency of the liquid-extension-pipe inlet/outlet density difference $\Delta\rho$ is markedly changed around a quality of 0.1. It is found that the change in refrigerant density difference with respect to the quality is large with a quality lower than 0.1, and the change in refrigerant density difference with respect to the quality is small with a quality of 0.1 or higher. With this finding, by controlling the liquid-extension-pipe quality to be 0.1 or higher, the liquid-extension-pipe inlet/outlet refrigerant density difference Δρ can be decreased.

With this configuration, to decrease the liquid-extension-pipe inlet/outlet density difference and to decrease the liquid-extension-pipe refrigerant density, it is found that the quality at the outlet of the liquid extension pipe (two-phase pipe) 6 is set at 0.1 or higher. Also, the upper limit of the quality at the outlet of the liquid extension pipe (two-phase pipe) 6 is set at 0.7 or lower. The grounds are described below.

To calculate the refrigerant amount in the condenser, the refrigerant is required to be in a saturated liquid state or a subcooled liquid state. This is because if the refrigerant at the condenser outlet is in two phase state, the condenser refrigerant amount cannot be correctly calculated. Regarding the refrigerant in the saturated liquid state or the subcooled liquid state at the condenser outlet, the saturated liquid state attains the condition with the highest enthalpy.

Next, the condition with the highest enthalpy in the saturated liquid state is calculated.

Figure 11:
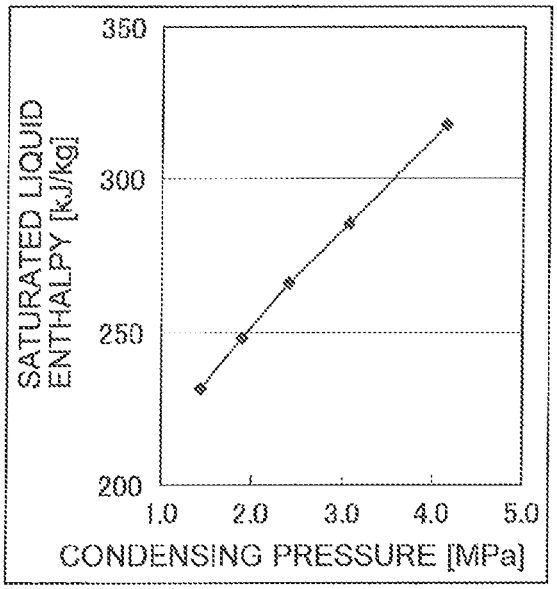
FIG. 11 is an illustration showing the relationship between the condensing pressure and the enthalpy with the refrigerant R410A in a saturated liquid state.

FIG. 11 is an illustration showing the relationship between the condensing pressure and the enthalpy with the refrigerant R410A in the saturated liquid state.

As found from this graph, as the pressure is higher, the enthalpy is higher. The refrigerating and air-conditioning apparatus using the refrigerant R410A has a design pressure of 4.15 [MPa] or lower. Therefore, the condition with the highest enthalpy when the refrigerant at the condenser outlet is in the saturated liquid state is a condition that the high pressure (condensing pressure) is 4.15 [MPa] being the highest.

Next, a condition with the highest two-phase pipe outlet quality in the state with the highest condenser outlet enthalpy is calculated.

Figure 12:
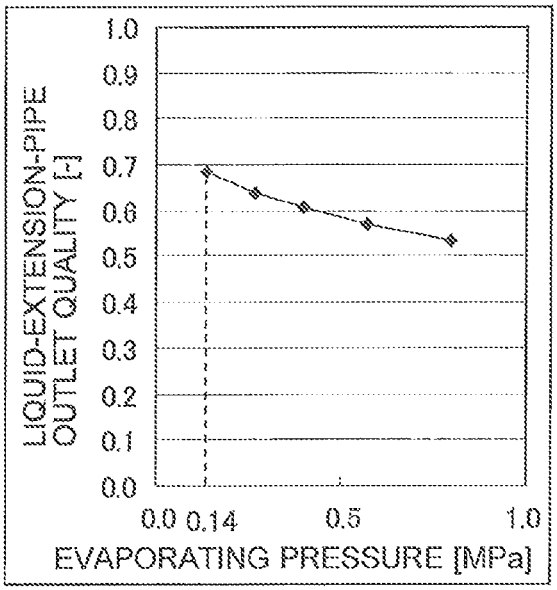
FIG. 12 is an illustration showing the relationship between the low pressure (evaporating pressure) and the liquid-extension-pipe outlet quality with the refrigerant R410A when the condenser outlet is in the same state and the pressure reducing amount at an expansion valve is changed.

FIG. 12 is an illustration showing the relationship between the low pressure (evaporating pressure) and the liquid-extension-pipe outlet quality with the refrigerant R410A when the condenser outlet is in the same state and the pressure reducing amount at the expansion valve is changed.

As the low pressure is decreased, the liquid-extension-pipe outlet quality is increased. Accordingly, the liquid-extension-pipe outlet quality becomes the highest when the low pressure is the lowest. The lowest pressure to be used in the refrigerating and air-conditioning apparatus using the refrigerant R410A is 0.14 [MPa](−45 degrees C.), and hence the maximum two-phase-pipe outlet quality is 0.7.

Figure 13:
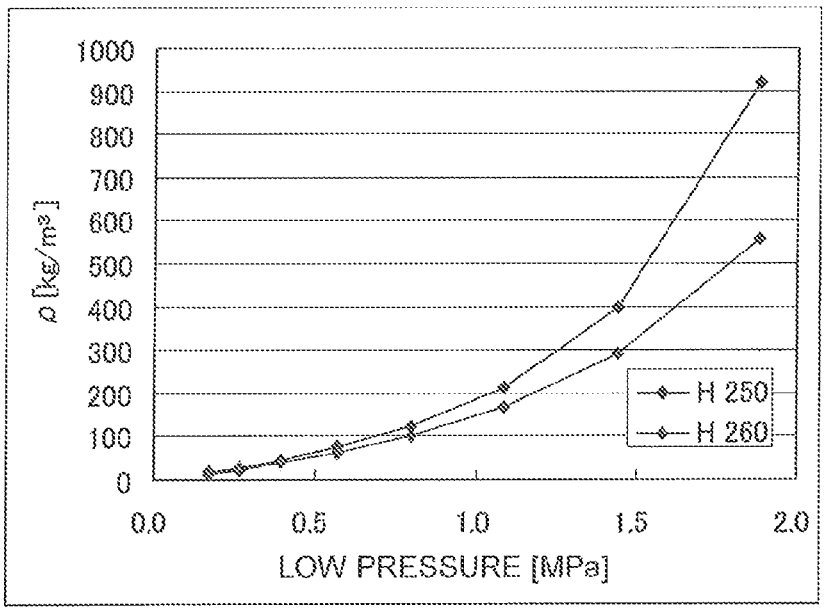
FIG. 13 is an illustration showing the relationship between the low pressure and the liquid-extension-pipe refrigerant density ρ using the refrigerant R410A with an enthalpy of 250 [kg/kJ] and an enthalpy of 260 [kg/kJ].

FIG. 13 is an illustration showing the relationship between the low pressure and the liquid-extension-pipe refrigerant density ρ using the refrigerant R410A with an enthalpy of 250 [kg/kJ] and an enthalpy of 260 [kg/kJ].

The tendency is changed around a low pressure of 1.0 [MPa]. It is found that the change in refrigerant density with respect to the low pressure is large with a low pressure higher than 1.0 [MPa], and the change in refrigerant density is small with respect to a low pressure of 1.0 [MPa] or lower. Accordingly, by controlling the low pressure to be 1.0 [MPa] or lower, the liquid-extension-pipe refrigerant density can be decreased.

Figure 14:
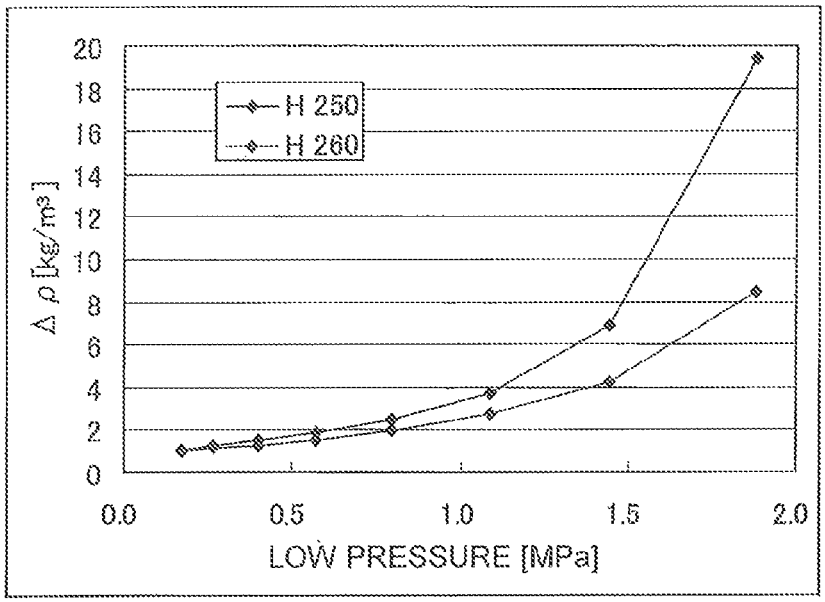
FIG. 14 is an illustration showing the relationship between the low pressure and the liquid-extension-pipe inlet/outlet refrigerant density difference Δρ [kg/m$^3$] with the refrigerant R410A.

FIG. 14 is an illustration showing the relationship between the low pressure and the liquid-extension-pipe inlet/outlet refrigerant density difference Δρ [kg/m$^3$] with the refrigerant R410A. FIG. 14 is an illustration in the cases of an enthalpy of 250 [kg/kJ] and an enthalpy of 260 [kg/kJ] when the liquid-extension-pipe inlet pressure is 0.933 [MPa], the outlet pressure is 0.833 [MPa], and the liquid-extension-pipe pressure loss is 0.1 [MPa].

The tendency is changed around a low pressure of 1.0 [MPa]. It is found that the change in refrigerant density difference with respect to the low pressure is large with a low pressure higher than 1.0 [MPa], and the change in refrigerant density difference is small with respect to a low pressure of 1.0 [MPa] or lower. Accordingly, by controlling the low pressure to be 1.0 [MPa] or lower, the liquid-extension-pipe inlet/outlet refrigerant density difference Δρ can be decreased.

Figure 15:
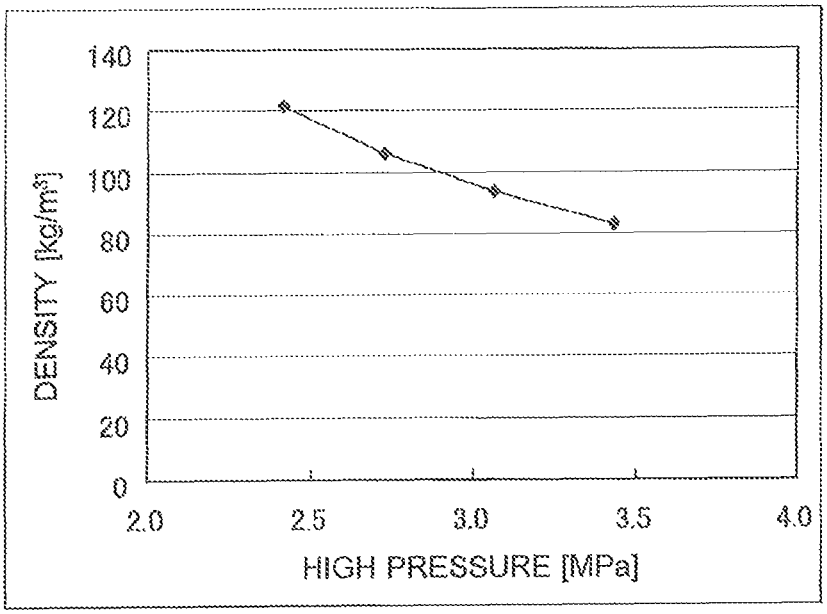
FIG. 15 is an illustration showing a change in liquid-extension-pipe refrigerant density with the refrigerant R410A when the high pressure is changed.

FIG. 15 is an illustration showing a change in liquid-extension-pipe refrigerant density with the refrigerant R410A when the high pressure is changed.

Calculation conditions for the liquid-extension-pipe refrigerant density are that the low pressure is 0.933 [MPa] and the enthalpy is in the saturated liquid state with the high pressure. The influence of the change in liquid-extension-pipe refrigerant density with respect to the change in high pressure is calculated. It is found that as the high pressure is increased from FIG. 15, the liquid-extension-pipe refrigerant density is decreased. Accordingly, by increasing the high pressure as possible, the liquid-extension-pipe refrigerant density can be decreased.

Also, another method of decreasing the liquid-extension-pipe inlet/outlet refrigerant density difference Δρ may be a method of decreasing the liquid-extension-pipe inlet/outlet refrigerant pressure loss as described below.

(Method of Decreasing Liquid-Extension-Pipe Inlet/Outlet Pressure Loss)

To decrease the liquid-extension-pipe inlet/outlet pressure loss, the refrigerant circulation amount is required to be decreased. As a method of decreasing the refrigerant circulation amount, there is a method (a) or (b), and as a method of realizing (b), there is a method of (b-1), (b-2), or (b-3).

(a) The compressor frequency is decreased.

(b) The suction density of the compressor 21 is decreased by decreasing the low pressure.

(b-1) The suction superheat degree of the compressor 21 is increased.

(b-2) The low pressure (the compressor suction pressure) is decreased (if excessive liquid refrigerant is present in the accumulator 24).

In Embodiment 1, since the excessive liquid refrigerant is present in the accumulator 24 in heating operation, the suction superheat degree of the compressor 21 cannot be increased. Therefore, if the excessive liquid refrigerant is present in the accumulator 24 like Embodiment 1, by decreasing the low pressure, the compressor suction density is decreased, and hence the refrigerant circulation amount can be decreased. To decrease the low pressure, for example, it is effective to decrease heat exchange efficiency of the evaporator. The decrease in heat exchange efficiency can be attained by decreasing the air amount of the evaporator fan.

(b-3) The suction superheat degree of the compressor 21 is increased (if excessive liquid refrigerant is not present in the accumulator 24).

Also, if the excessive liquid refrigerant is not present in the accumulator 24, a method of increasing the suction superheat degree of the compressor 21 is effective to decrease the suction density of the compressor 21. To increase the suction superheat degree of the compressor 21, for example, it is effective to increase the heat exchange efficiency of the evaporator. There may be a method of increasing the air amount of the evaporator fan to be larger than that in normal operation (operation for controlling the indoor temperature to be a set temperature), or a method of decreasing the amount of refrigerant passing through the evaporator.

<Refrigerant-Leakage Detection Method>

An operating method to increase the refrigerant-amount calculation accuracy is described with regard to the above-described characteristics of the refrigerant.

(Control to Set Quality in Range from 0.1 to 0.7)

As described above, by controlling the liquid-extension-pipe outlet quality to be in the range from 0.1 to 0.7, the liquid-extension-pipe inlet/outlet density difference can be decreased, and the liquid-extension-pipe refrigerant density can be decreased. To control the quality to be in the range from 0.1 to 0.7, for example, there may be four methods of (a-1), (a-2), (b-1), and (c-1). In this case, refrigerant-leakage detection in heating operation is described. Hence, in the following description, the condenser is the indoor heat exchanger 42, and the evaporator is the outdoor heat exchanger 23.

(a) Control on Expansion Valve (a-1) The expansion valve 41 is controlled so that the condenser outlet becomes the saturated liquid state.

(a-2) The expansion valve 41 is controlled so that the degree of subcooling at the condenser outlet becomes as small as possible.

Here, setting the degree of subcooling at the condenser outlet to be as small as possible is because the detection accuracy is degraded if the degree of subcooling is zero. That is, if the degree of subcooling is zero at the condenser outlet, and the condenser outlet becomes two-phase state, the condenser outlet state is uncertain and the liquid-extension-pipe outlet state is uncertain. Hence, the refrigerant amount estimation accuracy is degraded.

(b) Control on Evaporator Fan (Indoor Fan 43)

(b-1) The heat exchange amount of the evaporator is decreased to decrease the low pressure, that is, the rotation speed of the evaporator fan is decreased to be smaller than the rotation speed in normal operation to decrease the air amount of the evaporator.

(c) Control on Condenser Fan (Outdoor Fan 27)

(c-1) The rotation speed of the condenser fan is decreased.

To set the quality at 0.1 or higher, it is effective to increase the condenser outlet enthalpy. Hence, it is effective to increase the high pressure to increase the condenser outlet enthalpy, that is, to decrease the rotation speed of the condenser fan to be smaller than the rotation speed in normal operation.

(Control of Setting Low Pressure at 1.0 [MPa] or Lower)

As described above, by controlling the low pressure to be 1.0 [MPa] or lower, the liquid-extension-pipe inlet/outlet density difference can be decreased, and the liquid-extension-pipe refrigerant density can be decreased. To set the low pressure at 1.0 [MPa] or lower, for example, there is the following method (a-1).

(a) Control on Evaporator Fan (a-1) The heat exchange amount of the evaporator is decreased to decrease the low pressure, that is, the rotation speed of the evaporator fan is decreased to be smaller than the rotation speed in normal operation to decrease the air amount of the evaporator.

<Determination on Refrigerant Leakage>

Refrigerant leakage is determined based on the filled refrigerant amount when the refrigerating and air-conditioning apparatus 1 is installed as a reference, or the refrigerant amount (initial refrigerant amount) when the refrigerant amount is calculated immediately after the installation as a reference. Refrigerant leakage is determined by comparing the reference refrigerant amount with the calculated refrigerant amount $M_r$ calculated by the above-described method every time when refrigerant-leakage detection operation is executed. That is, refrigerant leakage is determined if the calculated refrigerant amount $M_r$ becomes smaller than the reference refrigerant amount.

Figure 16:
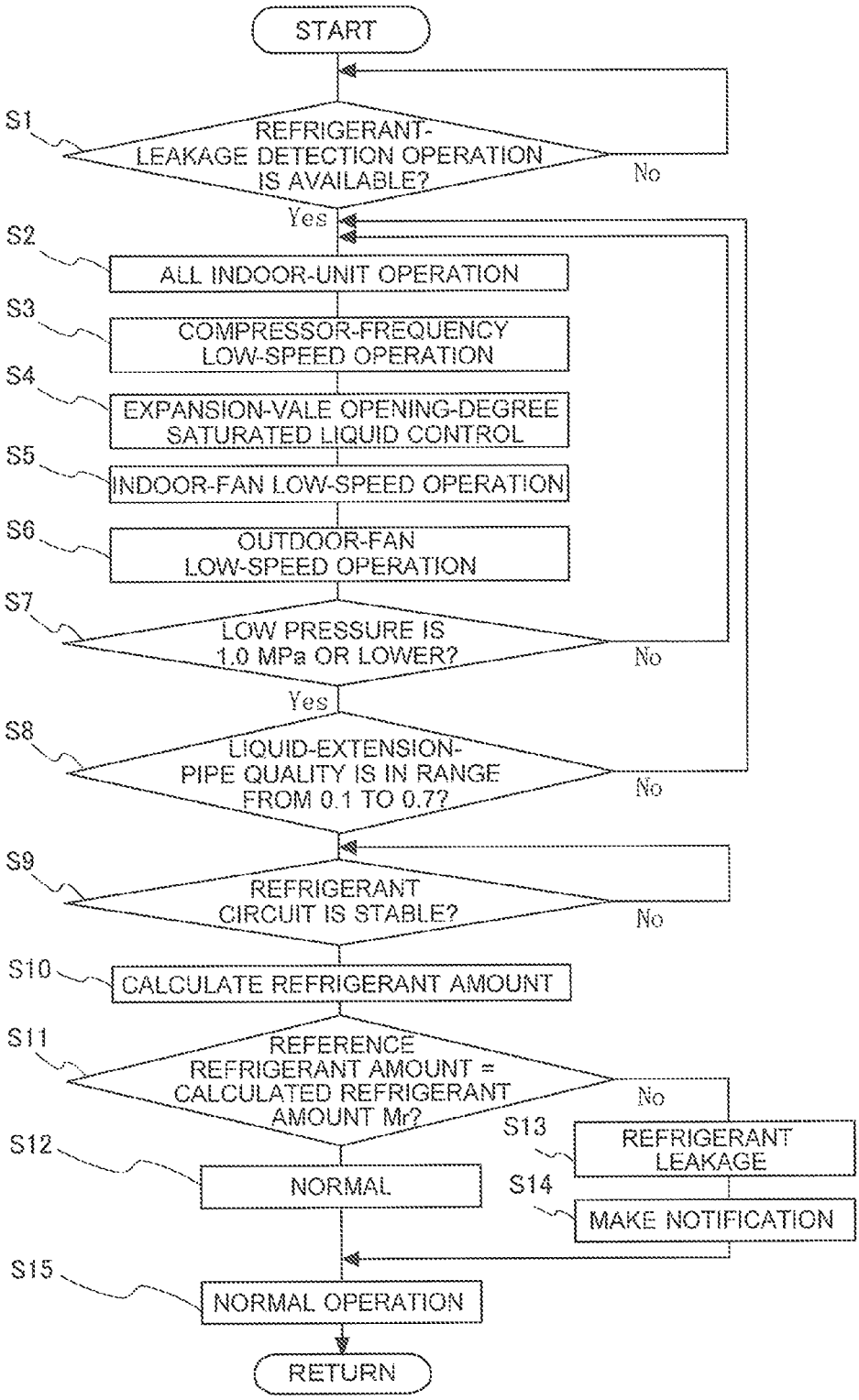
FIG. 16 is a flowchart showing a flow of refrigerant-leakage detection operation in the refrigerating and air-conditioning apparatus 1 according to Embodiment 1 of the present invention.

FIG. 16 is a flowchart showing a flow of the refrigerant-leakage detection operation in the refrigerating and air-conditioning apparatus 1 according to Embodiment 1 of the present invention. Hereinafter, the flow of the refrigerant-leakage detection operation is described with reference to FIG. 16.

(S1)

First, the controller 3 determines whether or not the refrigerant-leakage detection operation is available. The refrigerant-leakage detection operation differs from normal operation and is special operation that aims at an increase in refrigerant-amount arithmetic-operation accuracy (increase in refrigerant-leakage detection accuracy). That is, the operation gives a higher priority to controlling the outlet quality of the liquid extension pipe 6 to be in the range from 0.1 to 0.7 rather than indoor conformity. If the influence on the indoor side is large, for example, when the load is large and the conformity is significantly degraded, the refrigerant-leakage detection operation is not executed. That is, the refrigerant-leakage detection operation is executed in a time period that does not influence the indoor side. For example, the operation is executed in preheating for executing scheduled operation or after the refrigerating and air-conditioning apparatus is stopped. Also, in heating operation, the load is decreased during the daytime with the ambient temperature rising. The refrigerant-leakage detection operation is executed during a time period with a small load, for example, when the indoor temperature approaches the set temperature. Accordingly, in S1, it is judged whether or not the current time point is a time point at which the refrigerant-leakage detection operation is permitted.

(S2)

If the refrigerant-leakage detection is executed, all unit operation for operating all the connected indoor units 4 is required to be executed. The reason is as follows. If the indoor unit 4 is stopped, the expansion valve 41 is completely closed, and hence the refrigerant may be settled in the stopped indoor unit 4. That is, the reason is that since the refrigerant is settled, the refrigerant amount is no longer correctly calculated. Hence, in S2, the controller 3 executes all unit operation of the indoor units 4.

(S3)

The controller 3 executes low-speed operation in which the compressor frequency is set at a compressor frequency being a half of a rated compressor frequency. The reason is as follows. To increase the liquid-extension-pipe refrigerant-amount calculation accuracy, as described above, the pressure loss is required to be decreased at the liquid-extension-pipe inlet and outlet. Hence, the refrigerant circulation amount is required to be as small as possible. In contrast, to increase the refrigerant-amount calculation accuracy of the condenser, the refrigerant circulation amount is required to be increased by a certain degree. This is to decrease the influence of the pressure head as described above, and to prevent the path balance in the condenser to be degraded.

The proper refrigerant circulation amount varies depending on the specifications of the heat exchanger, such as the heat exchanger height, the pressure loss in the heat exchanger, the pressure loss (pipe diameter, length) in a capillary tube for distributing the refrigerant to respective paths of the heat exchanger. However, for example, if the rated circulation amount (the refrigerant circulation amount that meets a rated capacity) serves as a reference, and if the circulation amount is a half or more of the rated circulation amount, it can be conceived that the influence of the pressure head can be eliminated and the influence of the degradation in path balance can be decreased. Hence, to increase the refrigerant-amount calculation accuracy, the compressor frequency is decreased to a compressor frequency being a half of the rated compressor frequency in S3 so that the refrigerant circulation amount becomes a half of the rated circulation amount.

(S4 to S6)

Then, the controller 3 executes control from S4 to S6 to set the liquid-extension-pipe (two-phase-pipe) inlet/outlet quality in the range from 0.1 to 0.7, and to set the low pressure at 1.0 [MPa] or lower. That is, the controller 3 executes expansion-vale opening-degree saturated liquid control (S4), indoor-fan low-speed operation (S5), and outdoor-fan low-speed operation (S6).

(S7)

Then, the controller 3 determines whether or not the low pressure is 1 [MPa] or lower. If the low pressure is not 1 [MPa] or lower, the controller 3 returns to S2, and continuously executes element unit control, and executes control so that the low pressure becomes 1 [MPa] or lower. In this case, control is executed so that the low pressure (evaporating pressure) becomes 0.933 [MPa].

(S8)

If the controller 3 determines that the low pressure is 1 [MPa] or lower, the controller 3 determines whether or not the liquid-extension-pipe outlet quality is in the range from 0.1 to 0.7. If the controller 3 determines that the liquid-extension-pipe outlet quality is not in the range from 0.1 to 0.7, the controller 3 returns to S2, and continuously executes the element unit control, and executes control so that the liquid-extension-pipe quality becomes within the range from 0.1 to 0.7.

(S9)

If the controller 3 determines that the liquid-extension-pipe outlet quality is in the range from 0.1 to 0.7, the controller 3 determines whether or not the refrigerant circuit state is stable. If the controller 3 determines that the refrigerant circuit state is not stable, and if the refrigerant amount is calculated in this state, the refrigerant-amount calculation error is increased. Therefore, the controller 3 waits until the refrigerant circuit state becomes stable.

(S10)

Then, if the controller 3 determines that the refrigerant circuit state is stable, acquires the operating state amount with the various sensors, and calculates the refrigerant amount as described above.

(S11)

Then, the controller 3 compares the reference refrigerant amount with the calculated refrigerant amount $M_r$ calculated in S10.

(S12 to S14)

If the reference refrigerant amount is equal to the calculated refrigerant amount $M_r$, the controller 3 judges that the state is normal. In contrast, if the calculated refrigerant amount $M_r$ is smaller than the initial refrigerant amount, the controller 3 judges that the state is refrigerant leakage, and makes a notification. Alternatively, a range may be provided around the reference refrigerant amount, and the state may be judged as being normal if the calculated refrigerant amount $M_r$ is within the range and the state may be judged as refrigerant leakage if the calculated refrigerant amount $M_r$ is smaller than the range.

(S15)

Since the presence of refrigerant leakage can be judged in the flow from S1 to S14 as described above, the controller 3 ends the leakage detection operation, and switches operation the normal operation.

As described above, with Embodiment 1, when refrigerant leakage is detected, the quality at the outlet of the liquid extension pipe 6 is controlled to be in the range from 0.1 to 0.7, and the low pressure is controlled to be 1.0 [MPa] or lower. Accordingly, the liquid-extension-pipe inlet/outlet density difference can be decreased as possible. Consequently, the refrigerant amount-calculation error can be decreased, and the liquid-extension-pipe refrigerant amount $M_{rPL}$ can be calculated with high accuracy. Also, the refrigerant density of the liquid extension pipe 6 is decreased and the refrigerant amount in the liquid extension pipe 6 is decreased in advance. Accordingly, since the ratio of the refrigerant amount of the liquid extension pipe 6 with respect to the total refrigerant amount is decreased, the influence of the refrigerant-amount calculation error generated at the liquid extension pipe 6 on the calculation of the total calculated refrigerant amount $M_r$ can be decreased. Consequently, the refrigerant amount $M_r$ in the entire refrigerant circuit can be calculated with high accuracy, and the refrigerant-leakage detection accuracy can be increased.

In the description of Embodiment 1, the quality at the outlet of the liquid extension pipe 6 is controlled to be in the range from 0.1 to 0.7 and the low pressure is controlled to be 1.0 [MPa] or lower. However, as long as the quality at the outlet of the liquid extension pipe 6 is in the range from 0.1 to 0.7, the refrigerant density of the liquid extension pipe 6 can be correctly calculated, and the liquid-extension-pipe refrigerant amount $M_{rPL}$ can be calculated with high accuracy. Therefore, by executing control in at least one of S3 to S6 in the illustration, the liquid-extension-pipe refrigerant amount $M_{rPL}$ can be calculated with high accuracy. Also, by setting the low pressure at 1.0 [MPa] or lower, the effect can be further enhanced.

Embodiment 2

Figure 17:
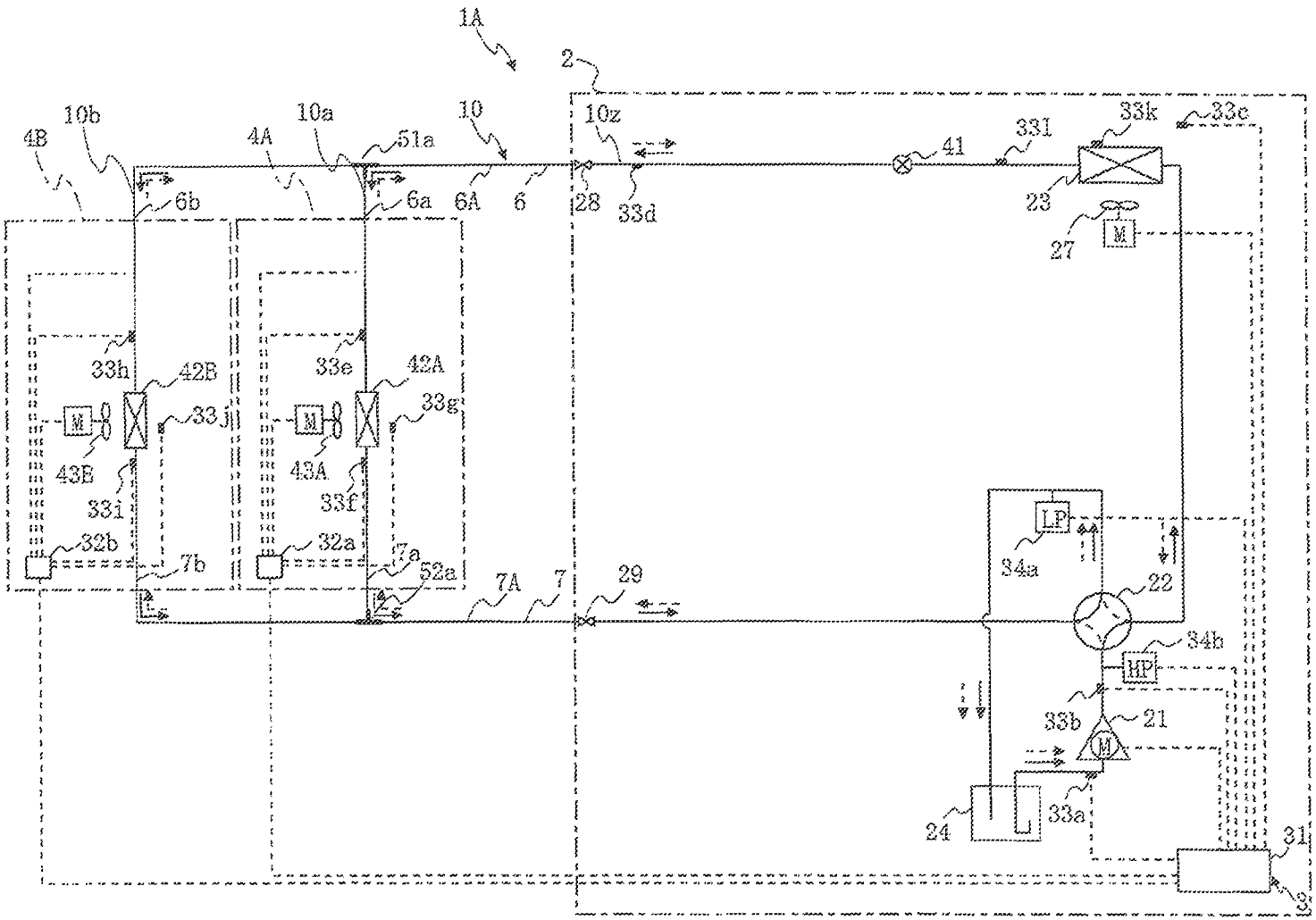
FIG. 17 is a schematic configuration diagram showing an example of a refrigerant circuit configuration of a refrigerating and air-conditioning apparatus 1A according to Embodiment 2 of the present invention.
Figure 18:
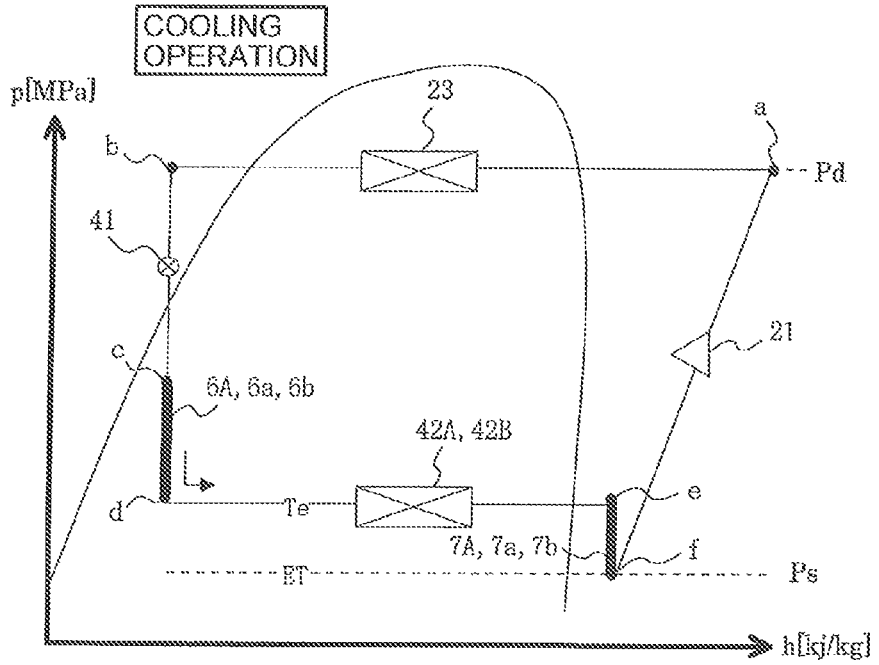
FIG. 18 is a p-h diagram in cooling operation of the refrigerating and air-conditioning apparatus 1A according to Embodiment 2 of the present invention.
Figure 19:
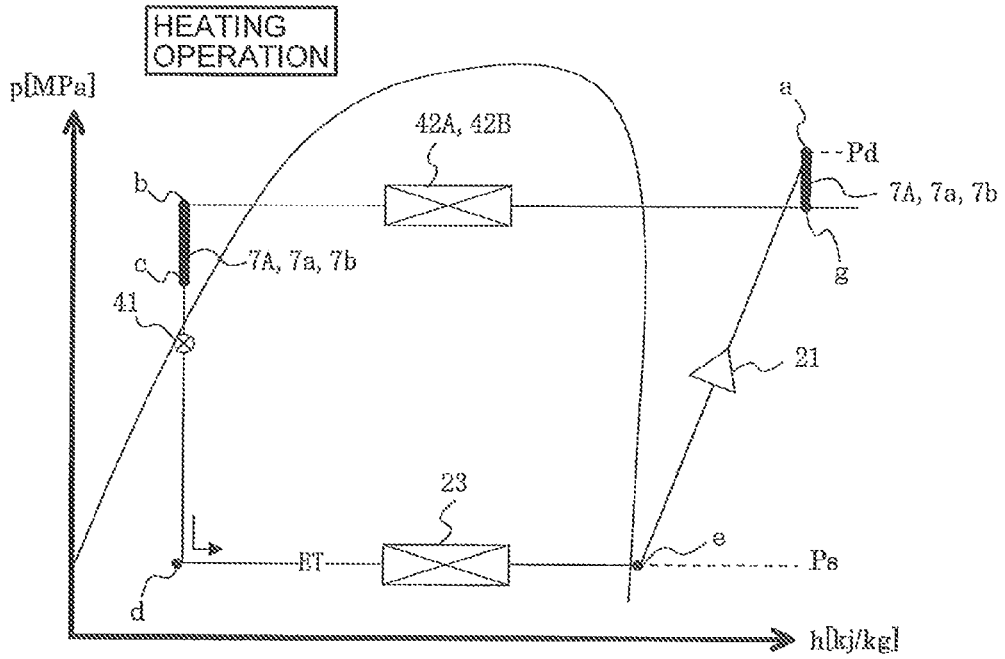
FIG. 19 is a p-h diagram in heating operation of the refrigerating and air-conditioning apparatus 1A according to Embodiment 2 of the present invention.

FIG. 17 is a schematic configuration diagram showing an example of a refrigerant circuit configuration of a refrigerating and air-conditioning apparatus 1A according to Embodiment 2 of the present invention. FIG. 18 is a p-h diagram in cooling operation of the refrigerating and air-conditioning apparatus 1A according to Embodiment 2 of the present invention. FIG. 19 is a p-h diagram in heating operation of the refrigerating and air-conditioning apparatus 1A according to Embodiment 2 of the present invention. With reference to FIGS. 17 to 19, the refrigerant circuit configuration and operation of the refrigerating and air-conditioning apparatus 1A are described. In Embodiment 2, points different from Embodiment 1 are mainly described, and the same reference sign is applied to the same portion as Embodiment 1, and the redundant description is omitted. Also, the modifications applied to the configuration portions similar to Embodiment 1 are also applied to Embodiment 2.

Similarly to the refrigerating and air-conditioning apparatus 1, the refrigerating and air-conditioning apparatus 1A is installed in, for example, a building or a condominium, and is used for cooling and heating an air-conditioned space in which the refrigerating and air-conditioning apparatus 1A is installed, by executing vapor-compressing refrigeration cycle operation. The refrigerating and air-conditioning apparatus 1A has a configuration in which the expansion valves 41A and 41B are removed from the respective indoor units 4A and 4B in the refrigerating and air-conditioning apparatus 1 of Embodiment 1, and an expansion valve 41 is newly added to the outdoor unit 2. Other configurations are similar to the configurations described in Embodiment 1.

The refrigerant states in cooling operation and heating operation in the refrigerating and air-conditioning apparatus 1A are described with reference to FIGS. 17 and 18.

(Cooling Operation)

Cooling operation that is executed by the refrigerating and air-conditioning apparatus 1A is described with reference to FIGS. 17 and 18.

In cooling operation, the four-way valve 22 is controlled in a state indicated by solid lines in FIG. 1, and the refrigerant circuit becomes a connection state as follows. That is, the discharge side of the compressor 21 is connected to the gas side of the outdoor heat exchanger 23. Also, the suction side of the compressor 21 is connected to the gas side of the indoor heat exchanger 42 through the gas-side closing valve 29 and the gas extension pipe 7 (the gas main extension pipe 7A, the gas branch extension pipe 7*a*, and the gas branch extension pipe 7*b*). The liquid-side closing valve 28 and the gas-side closing valve 29 are in open state.

Low-temperature and low-pressure refrigerant is compressed by the compressor 21, becomes high-temperature and high-pressure gas refrigerant, and is discharged (point a in FIG. 18). The high-temperature and high-pressure gas refrigerant discharged from the compressor 21 flows into the outdoor heat exchanger 23 through the four-way valve 22. The refrigerant flowing into the outdoor heat exchanger 23 is condensed and liquefied while transferring heat to the outdoor air by air-sending effect of the outdoor fan 27 (point b in FIG. 18). The condensing temperature at this time can be detected by the heat exchange temperature sensor 33*k* or obtained by converting the pressure detected by the discharge pressure sensor 34*b* into the saturation temperature.

Then, the pressure of the high-pressure liquid refrigerant flowing out from the outdoor heat exchanger 23 is decreased by the expansion valve 41, and hence the refrigerant becomes two-phase gas-liquid refrigerant with low pressure (point c in FIG. 18). Then, the refrigerant flows out from the outdoor unit 2 through the liquid-side closing valve 28. The pressure of the high-pressure liquid refrigerant flowing out from the outdoor unit 2 is decreased in the liquid main extension pipe 6A, the liquid branch extension pipe 6*a*, and the liquid branch extension pipe 6*b* due to friction with pipe wall surfaces (point d in FIG. 18). Then, the two-phase gas-liquid refrigerant flows into the indoor heat exchanger 42 functioning as an evaporator, and receives heat from the air by air-sending effect of the indoor fan 43. Thus, the two-phase gas-liquid refrigerant is evaporated and gasified (point e in FIG. 18). At this time, cooling is executed in the air-conditioned space.

The evaporating temperature at this time is measured by the liquid-side temperature sensor 33*e* and the liquid-side temperature sensor 33*h*. Superheat degrees SH of the refrigerant at the outlets of the indoor heat exchangers 42A and 42B are obtained by subtracting refrigerant temperatures detected by the liquid-side temperature sensor 33*e* and the liquid-side temperature sensor 33*h* from refrigerant temperature values detected by the gas-side temperature sensor 33*f* and the gas-side temperature sensor 33*i*.

Also, the opening degree of the expansion valve 41 is controlled so that the superheat degree SH of the refrigerant at the outlet of the indoor heat exchanger 42 (that is, at the gas side of the indoor heat exchanger 42A and the gas side of the indoor heat exchanger 42B) becomes a superheat degree target value SHm.

The gas refrigerant passing through the indoor heat exchanger 42 passes through the gas main extension pipe 7A, the gas branch extension pipe 7*a*, and the gas branch extension pipe 7*b*, and the pressure of the refrigerant is decreased due to friction with pipe wall surfaces when the gas refrigerant passes through the gas main extension pipe 7A, the gas branch extension pipe 7*a*, and the gas branch extension pipe 7*b* (point f in FIG. 18). The refrigerant flows into the outdoor unit 2 through the gas-side closing valve 29. The refrigerant flowing into the outdoor unit 2 is sucked again into the compressor 21 through the four-way valve 22 and the accumulator 24. The refrigerating and air-conditioning apparatus 1A executes cooling operation in the flow described above.

(Heating Operation)

Heating operation that is executed by the refrigerating and air-conditioning apparatus 1A is described with reference to FIGS. 17 and 19.

In heating operation, the four-way valve 22 is controlled in a state indicated by broken lines in FIG. 1, and the refrigerant circuit becomes a connection state as follows. That is, the discharge side of the compressor 21 is connected to the gas side of the indoor heat exchanger 42 through the gas-side closing valve 29 and the gas extension pipe 7 (the gas main extension pipe 7A, the gas branch extension pipe 7*a*, and the gas branch extension pipe 7*b*). Also, the suction side of the compressor 21 is connected to the gas side of the outdoor heat exchanger 23. The liquid-side closing valve 28 and the gas-side closing valve 29 are in open state.

Low-temperature and low-pressure refrigerant is compressed by the compressor 21, becomes high-temperature and high-pressure gas refrigerant, and is discharged (point a in FIG. 19). The high-temperature and high-pressure gas refrigerant discharged from the compressor 21 flows out from the outdoor unit 2 through the four-way valve 22 and the gas-side closing valve 29. The high-temperature and high-pressure gas refrigerant flowing out from the outdoor unit 2 passes through the gas main extension pipe 7A, the gas branch extension pipe 7*a*, and the gas branch extension pipe 7*b*, and at this time the pressure of the refrigerant is decreased due to friction with pipe wall surfaces (point g in FIG. 19). This refrigerant flows into the indoor heat exchanger 42 of the indoor unit 4. The refrigerant flowing into the indoor heat exchanger 42 is condensed and liquefied while transferring heat to the indoor air by air-sending effect of the outdoor fan 43 (point b in FIG. 19). At this time, heating is executed in the air-conditioned space.

Then, the refrigerant flowing out from the indoor heat exchanger 42 passes through the liquid main extension pipe 6A, the liquid branch extension pipe 6*a*, and the liquid branch extension pipe 6*b*, the pressure of the refrigerant is decreased due to friction with pipe wall surfaces when passing through the liquid main extension pipe 6A, the liquid branch extension pipe 6*a*, and the liquid branch extension pipe 6*b* (point c in FIG. 19), and then the refrigerant flows into the outdoor unit 2 through the liquid-side closing valve 28.

The pressure of the refrigerant flowing into the outdoor unit 2 is decreased by the expansion valve 41, and hence the refrigerant becomes two-phase gas-liquid refrigerant with low pressure (point d in FIG. 19). At this time, the opening degree of the expansion valve 41 is controlled so that subcooling degree SC of the refrigerant at the outlet of the indoor heat exchanger 42 becomes constant at a subcooling degree target value SCm.

The subcooling degrees SC of the refrigerant at the outlets of the indoor heat exchangers 42A and 42B are obtained as follows. First, the discharge pressure $P_d$ of the compressor 21 detected by the discharge pressure sensor 34*b* is converted into a saturation temperature value corresponding to the condensing temperature Tc. Then, each of the refrigerant temperature values detected by the liquid-side temperature sensors 33*e* and the liquid-side temperature sensor 33*h* is subtracted from the saturation temperature value. Thus, the subcooling degrees SC are obtained. Alternatively, a temperature sensor that detects the temperature of refrigerant flowing through each indoor heat exchanger 42 may be additionally provided, and the subcooling degrees SC may be obtained by subtracting the refrigerant temperature values corresponding to the condensing temperatures Tc detected by the temperature sensors from the refrigerant temperature values detected by the liquid-side temperature sensor 33*e* and the liquid-side temperature sensor 33*h*.

Then, the two-phase gas-liquid refrigerant with low pressure flows into the outdoor heat exchanger 23, and is evaporated and gasified by receiving heat from the outdoor air by air-sending effect of the outdoor fan 27 (point e in FIG. 19). Then, the refrigerant is sucked again into the compressor 21 through the four-way valve 22 and the accumulator 24. The refrigerating and air-conditioning apparatus 1A executes heating operation in the flow described above.

Also in cooling operation of Embodiment 2, similarly to heating operation of Embodiment 1, the refrigerant density varies due to the liquid-extension-pipe inlet/outlet pressure loss. Hence, by decreasing the liquid-extension-pipe inlet/outlet density difference by a method similar to the method described in Embodiment 1, the liquid-extension-pipe refrigerant-amount calculation error can be decreased. That is, in refrigerant-leakage detection operation of Embodiment 2, all the indoor units 4 are operated in cooling operation, and low-speed operation is executed in which the compressor frequency is set at a compressor frequency being a half of a rated compressor frequency. Then, at least one control in S4 to S6 in FIG. 16 is only required to be executed. Also, by decreasing the liquid-extension-pipe refrigerant density and hence by decreasing the ratio of the liquid-extension-pipe refrigerant density with respect to the total refrigerant amount, the refrigerant-amount calculation accuracy can be increased, and the refrigerant-leakage detection accuracy can be increased.

Also, with any one of the refrigerating and air-conditioning apparatuses 1 and 1A according to Embodiment 1 and Embodiment 2, for example, by using movement average data, transient characteristics of data can be decreased and the accuracy in judging whether the refrigerant amount is excessive or insufficient can be increased.

Also, a local controller serving as a management device that manages respective configuration units may be connected to any one of the refrigerating and air-conditioning apparatus 1 and 1A according to Embodiment 1 and Embodiment 2 through a telephone line, a LAN line, or in a wireless manner so that communication can be made, and the operating state amount acquired in the refrigerating and air-conditioning apparatus 1 or 1A may be transmitted to the local controller. Then, the local controller may be connected to a remote server of an information management center arranged at a remote site through a network, and hence a refrigerant amount judgment system may be configured. In this case, the operating data acquired by the local controller is transmitted to the remote server. The operating state amount may be stored and saved in a memory device such as a disk device connected to the remote server, and the remote server may judge refrigerant leakage.

The configuration that judges refrigerant leakage in the remote server may be, for example, as follows. That is, there may be conceived a configuration in which the function of the measurement unit 3*a* that acquires the operating state amount and the function of the arithmetic unit 3*b* that performs arithmetic operation for the operating state amount of any one of the refrigerating and air-conditioning apparatuses 1 and 1A according to Embodiment 1 and Embodiment 2 are provided in the local controller, the memory unit 3*c* is provided in the storage device, and the function of the judgment unit 3*d* is provided in the remote server.

In this case, the refrigerating and air-conditioning apparatuses 1 and 1A according to Embodiment 1 and Embodiment 2 each no longer require to have the function of arithmetically operating and comparing the calculated refrigerant amount $M_r$ and the refrigerant leakage rate r from the current operating state amount. Also, by configuring the system that can monitor remotely, in periodic maintenance, a worker is not required to go to the installation site or to check whether the refrigerant is excessive or insufficient. Accordingly, reliability and operability of the device can be further increased.

The features of the present invention are described above by dividing the features into Embodiment 1 and Embodiment 2; however, the specific configuration is not limited to Embodiment 1 or Embodiment 2, and can be modified within the scope of the invention. For example, in any one of Embodiment 1 and Embodiment 2, the present invention is applied to the refrigerating and air-conditioning apparatus that can switch operation between cooling and heating; however, it is not limited thereto. The present invention may be applied to cooling-only or heating-only refrigerating and air-conditioning apparatus. Also, in any one of Embodiment 1 and Embodiment 2, the refrigerating and air-conditioning apparatus including the single outdoor unit 2 is exemplified; however, it is not limited thereto. The present invention may be applied to a refrigerating and air-conditioning apparatus including a plurality of outdoor units 2. Further, the features of Embodiment 1 and Embodiment 2 may be appropriately combined in accordance with the purpose of use and the object.

The refrigerant that is used in the refrigerating and air-conditioning apparatus according to any one of Embodiment 1 and Embodiment 2 is not limited to a particular kind of refrigerant. For example, any one of natural refrigerant (carbon dioxide ($CO_2$), hydrocarbon, helium, etc.), alternative refrigerant not containing chlorine (HFC410A, HFC407C, HFC404A, etc.), and chlorofluorocarbon-based refrigerant (R22, R134a, etc.) used in existing products may be used. Also, in any one of Embodiment 1 and Embodiment 2, the example in which the present invention is applied to the refrigerating and air-conditioning apparatus is described. However, the present invention can be applied to other systems such as a refrigeration system in which a refrigerant circuit is configured by using a refrigeration cycle.

REFERENCE SIGNS LIST

1 refrigerating and air-conditioning apparatus 1A refrigerating and air-conditioning apparatus 2 outdoor unit 3 controller 3*a* measurement unit 3*b* arithmetic unit 3*c* memory unit 3*d* judgment unit 3*e* drive unit 3*f* display unit 3*g* input unit 3*h* output unit 4 (4A, 4B) indoor unit 6 liquid extension pipe (second extension pipe) 6A liquid main extension pipe 6*a* liquid branch extension pipe 6*b* liquid branch extension pipe 7 gas extension pipe (first extension pipe) 7A gas main extension pipe 7*a* gas branch extension pipe 7*b* gas branch extension pipe 10 refrigerant circuit 10*a* indoor-side refrigerant circuit 10*b* indoor-side refrigerant circuit 10*z* outdoor-side refrigerant circuit 21 compressor 22 four-way valve 23 outdoor heat exchanger 24 accumulator 27 outdoor fan 28 liquid-side closing valve 29 gas-side closing valve 31 outdoor-side controller 32 indoor-side controller 33*a* suction temperature sensor 33*b* discharge temperature sensor 33*c* outdoor temperature sensor 33*d* liquid pipe temperature sensor 33*e* liquid-side temperature sensor 33*f* gas-side temperature sensor 33*g* indoor temperature sensor 33*h* liquid-side temperature sensor 33*i* gas-side temperature sensor 33*j* indoor temperature sensor 33*k* heat exchange temperature sensor 33*l* liquid-side temperature sensor 34*a* suction pressure sensor 34*b* discharge pressure sensor 35 liquid-level detection sensor 41(41A, 41B) expansion valve 42(42A, 42B) indoor heat exchanger 43(43A, 43B) indoor fan 51*a* distributor 52*a* distributor

The invention claimed is:

1. A refrigeration cycle apparatus comprising:

a refrigerant circuit configured to circulate refrigerant to a compressor, a condenser, an expansion valve, and an evaporator, the compressor being connected to the condenser by a first extension pipe, the expansion valve being connected to the evaporator by a second extension pipe;

a detection unit configured to detect an operating state amount of the refrigerant circuit; and a controller configured to execute a detection operation of detecting refrigerant leakage based on the operating state amount detected by the detection unit, wherein the controller controls a refrigerant state at an outlet of the condenser to become a saturated liquid state, and controls a quality of the refrigerant at an outlet of the second extension pipe to be in a range from 0.1 to 0.7 in the detection operation, wherein the refrigerant circuit includes the compressor, an outdoor heat exchanger serving as the condenser or the evaporator, the expansion valve, and a plurality of indoor heat exchangers serving as the evaporator or the condenser, wherein the compressor is connected to each of the plurality of indoor heat exchangers by the first extension pipe and the expansion valve is connected to the outdoor heat exchanger by the second extension pipe, wherein the controller causes all the plurality of indoor heat exchangers to serve as the condensers and controls a frequency of the compressor to be a first compressor frequency so that an evaporating pressure of the refrigerant circuit becomes equal to or lower than 1.0 MPa in the detection operation, and wherein the first compressor frequency is half of a rated compressor frequency.

2. The refrigeration cycle apparatus of claim 1, wherein the controller executes the detection operation by calculating a refrigerant amount in the refrigerant circuit based on the operating state amount detected by the detection unit and comparing the calculated refrigerant amount with a reference refrigerant amount.

3. The refrigeration cycle apparatus of claim 1, wherein the controller causes the expansion valve to control a refrigerant state at the outlet of the condenser and the quality of the refrigerant at the outlet of the second extension pipe.

4. The refrigeration cycle apparatus of claim 1, further comprising a four-way valve configured to switch a flow direction of the refrigerant, wherein the four-way valve causes the plurality of indoor heat exchangers to serve as the condensers or the evaporators.

5. The refrigeration cycle apparatus of claim 1, further comprising an evaporator fan configured to send air to the evaporator, wherein the controller switches operations between a normal operation and the detection operation, the controller controlling the refrigerant circuit to cause a temperature in an air-conditioned space to become a set temperature in the normal operation, the controller decreasing a rotation speed of the evaporator fan in the detection operation as compared with the rotation speed of the evaporator fan in the normal operation.

6. The refrigeration cycle apparatus of claim 1, further comprising a condenser fan configured to send the air to the condenser, wherein the controller switches the operations between a normal operation and the detection operation, the controller controlling the refrigerant circuit to cause the temperature in the air-conditioned space to become the set temperature in the normal operation, the controller decreasing a rotation speed of the condenser fan in the detection operation as compared with the rotation speed of the evaporator fan in the normal operation.

7. The refrigeration cycle apparatus of claim 1, wherein the refrigerant is R410A.

8. The refrigeration cycle apparatus of claim 1, wherein the evaporating pressure of the refrigerant circuit is 0.933 MPa.

9. A refrigeration cycle apparatus comprising:

a refrigerant circuit configured to circulate refrigerant to a compressor, a condenser, an expansion valve, and an evaporator, the compressor being connected to the condenser by a first extension pipe, the expansion valve being connected to the evaporator by a second extension pipe;

a detection unit configured to detect an operating state amount of the refrigerant circuit; and a controller configured to execute a detection operation of detecting refrigerant leakage based on the operating state amount detected by the detection unit, wherein the controller controls a refrigerant state at an outlet of the condenser to become a saturated liquid state, and controls a quality of the refrigerant at an outlet of the second extension pipe to be in a range from 0.1 to 0.7 in the detection operation, wherein the refrigerant circuit includes the compressor, the expansion valve, an outdoor heat exchanger serving as the condenser or the evaporator, and a plurality of indoor heat exchangers serving as the evaporator or the condenser, wherein the compressor is connected to each of the plurality of indoor heat exchangers by the first extension pipe and the expansion valve is connected to the outdoor heat exchanger by the second extension pipe, wherein the controller causes all the plurality of indoor heat exchangers to serve as the evaporators and controls a frequency of the compressor to be a first compressor frequency so that an evaporating pressure of the refrigerant circuit becomes equal to or lower than 1.0 MPa in the detection operation, and wherein the first compressor frequency is half of a rated compressor frequency.

10. The refrigeration cycle apparatus of claim 9, wherein the controller executes the detection operation by calculating a refrigerant amount in the refrigerant circuit based on the operating state amount detected by the detection unit and comparing the calculated refrigerant amount with a reference refrigerant amount.

11. The refrigeration cycle apparatus of claim 9, wherein the controller causes the expansion valve to control a refrigerant state at the outlet of the condenser and the quality of the refrigerant at the outlet of the second extension pipe.

12. The refrigeration cycle apparatus of claim 9, further comprising a four-way valve configured to switch a flow direction of the refrigerant, wherein the four-way valve causes the plurality of indoor heat exchangers to serve as the condensers or the evaporators.

13. The refrigeration cycle apparatus of claim 9, further comprising an evaporator fan configured to send air to the evaporator, wherein the controller switches operations between a normal operation and the detection operation, the controller controlling the refrigerant circuit to cause a temperature in an air-conditioned space to become a set temperature in the normal operation, the controller decreasing a rotation speed of the evaporator fan in the detection operation as compared with the rotation speed of the evaporator fan in the normal operation.

14. The refrigeration cycle apparatus of claim 9, wherein the refrigerant is R410A.

15. The refrigeration cycle apparatus of claim 9, wherein the evaporating pressure of the refrigerant circuit is 0.933 MPa.

16. The refrigeration cycle apparatus of claim 1, wherein the controller is configured to responsive to determining that the quality of the refrigerant at an outlet of the second extension pipe is in the range from 0.1 to 0.7 in the detection operation, calculate a refrigerant amount in the refrigerant circuit based on the operating state amount detected by the detection unit and compare the calculated refrigerant amount with a predetermined reference refrigerant amount to determine whether the refrigerant leakage is detected based on the calculated refrigerant amount being less than the predetermined reference refrigerant amount and notify of the detected refrigerant leakage.

17. The refrigeration cycle apparatus of claim 9, wherein the controller is configured to responsive to determining that the quality of the refrigerant at an outlet of the second extension pipe is in the range from 0.1 to 0.7 in the detection operation, calculate a refrigerant amount in the refrigerant circuit based on the operating state amount detected by the detection unit and compare the calculated refrigerant amount with a predetermined reference refrigerant amount to determine whether the refrigerant leakage is detected based on the calculated refrigerant amount being less than the predetermined reference refrigerant amount and notify of the detected refrigerant leakage.

* * * * *